US007758444B2

(12) United States Patent
Crossley

(10) Patent No.: US 7,758,444 B2
(45) Date of Patent: Jul. 20, 2010

(54) GOLF DRIVING RANGE PLATFORM

(75) Inventor: John Harold Crossley, Turramurra (AU)

(73) Assignee: D'Crouza Products Pty. Ltd., Sydney, NSW (AU)

( * ) Notice: Subject to any disclaimer, the term of this patent is extended or adjusted under 35 U.S.C. 154(b) by 50 days.

(21) Appl. No.: 11/664,547

(22) PCT Filed: Oct. 6, 2005

(86) PCT No.: PCT/AU2005/001521

§ 371 (c)(1),
(2), (4) Date: Nov. 29, 2007

(87) PCT Pub. No.: WO2006/037168

PCT Pub. Date: Apr. 13, 2006

(65) Prior Publication Data

US 2009/0111600 A1 Apr. 30, 2009

(30) Foreign Application Priority Data

Oct. 6, 2004 (AU) ..... 2004905780

(51) Int. Cl.
*A63B 69/36* (2006.01)

(52) U.S. Cl. ..... 473/279

(58) Field of Classification Search ..... 473/278, 473/279, 160, 161; 472/6, 8, 9, 11, 16, 19, 472/28, 29, 35, 47, 91, 92, 130, 135; 108/1–10
See application file for complete search history.

(56) References Cited

U.S. PATENT DOCUMENTS 3,693,979 A * 9/1972 Koett ..... 473/279

(Continued)

FOREIGN PATENT DOCUMENTS

GB 2 281 702 3/1995

(Continued)

*Primary Examiner*—Mark S Graham
(74) *Attorney, Agent, or Firm*—Ladas & Parry LLP

(57) ABSTRACT

A golf driving range platform (20) having: a base plate (22) having a lower surface (21) and an upper surface (23), the base plate lower surface (21) being provided to rest on a ground; a lower wedge (26) having a lower surface (27) and an upper surface (28) inclined relative to each other by a first predetermined angle (29), the lower wedge lower surface (27) being disposed above said base plate upper surface (23) and supported thereon, the lower wedge (26) being rotatable relative to said base plate (22) about a first rotation axis (40) extending substantially perpendicular to the base plate upper surface (23); an upper wedge (30) having a lower surface (31) and an upper surface (32) inclined relative to each other by a second predetermined angle (33), the upper wedge lower surface (31) being disposed above said lower wedge upper surface (28) and supported thereon, the upper wedge (30) being rotatable relative to said base plate (22) and said lower wedge (26); a top plate (34) having a lower surface (35) and an upper surface (36), the top plate lower surface (35) disposed above said upper wedge upper surface (32) and supported thereon, the upper wedge (30) being rotatable relative to said top plate (34) about a second rotation axis (41) extending substantially perpendicular to the top plate lower surface (35); and a joint means (42) connecting said top plate (34) to said base plate (22) such that the top plate (34) is substantially not rotatable relative to the base plate (22), the top plate (34) can tilt relative to the base plate (22), and the upper and lower wedges (30, 26) are rotatable relative to said top plate.

23 Claims, 23 Drawing Sheets

U.S. PATENT DOCUMENTS

| | | | | | |
|---|---|---|---|---|---|
| 4,779,796 | A | * | 10/1988 | Lai | 473/279 |
| 5,340,111 | A | | 8/1994 | Froelich | |
| 5,431,406 | A | * | 7/1995 | Ishii | 248/396 |
| 5,518,245 | A | | 5/1996 | Nelson | |
| 5,558,334 | A | * | 9/1996 | Roche | 473/279 |
| 5,820,478 | A | * | 10/1998 | Wood et al. | 473/279 |
| 2002/0187848 | A1 | * | 12/2002 | Tomczyk | 473/279 |
| 2005/0090325 | A1 | | 4/2005 | Jong | |

FOREIGN PATENT DOCUMENTS

| | | |
|---|---|---|
| GB | 2 364 504 | 1/2002 |
| WO | 00/69529 | 11/2000 |
| WO | 02/41956 | 5/2002 |

* cited by examiner

GOLF DRIVING RANGE PLATFORM

FIELD OF THE INVENTION

The present invention relates to a golf driving range platform.

BACKGROUND OF THE INVENTION

In present golf driving ranges, golfers are typically provided with flat golf mats simulating grass from which to hit golf balls for practice. Whilst such flat golf mats are appropriate for practicing one's golf swing, the flat golf mats do not allow better golfers to practice hitting a golf ball lying on a slope. A golfer must adapt his stance and swing to the shot required, particularly when standing on an uneven surface. This is particularly relevant as in most golf courses, emphasis is given to making holes more challenging and interesting by providing undulating fairways, hills or sunken portions.

It is thus desirable to provide a golf driving range platform which allows a golfer to vary the slope and direction of slope of the driving range platform to allow the golfer to practice shots on uneven slopes. Such a platform can also be used by golf instructors as a teaching aid.

SUMMARY OF THE INVENTION

The present invention provides a golf driving range platform having:

a base plate having a lower surface and an upper surface, the base plate lower surface being provided to rest on a ground;

a lower wedge having a lower surface and an upper surface inclined relative to each other by a first predetermined angle, the lower wedge lower surface being disposed above said base plate upper surface and supported thereon, the lower wedge being rotatable relative to said base plate about a first rotation axis extending substantially perpendicular to the base plate upper surface;

an upper wedge having a lower surface and an upper surface inclined relative to each other by a second predetermined angle, the upper wedge lower surface being disposed above said lower wedge upper surface and supported thereon, the upper wedge being rotatable relative to said base plate and said lower wedge;

a top plate having a lower surface and an upper surface, the top plate lower surface disposed above said upper wedge upper surface and supported thereon, the upper wedge being rotatable relative to said top plate about a second rotation axis extending substantially perpendicular to the top plate lower surface; and a joint means connecting said top plate to said base plate such that the top plate is substantially not rotatable relative to the base plate, the top plate can tilt relative to the base plate, and the upper and lower wedges are rotatable relative to said top plate.

In a preferred embodiment, the base plate and top plate are circular plates. In a preferred embodiment, the upper and lower wedges are circular rings. The base plate, top plate and upper and lower wedges are preferably substantially similar in diameter. The first and second rotation axes are preferably located at the center of the lower and upper wedges respectively.

The first and second predetermined angles are preferably equal. The lower wedge lower surface is preferably substantially perpendicular to the first rotation axis. The upper wedge upper surface is preferably substantially perpendicular to the second rotation axis.

The base plate preferably includes rubber feet at its lower surface. The top plate preferably includes a non-slip material at its upper surface. The joint means is preferably a universal joint.

The present invention in one embodiment further includes a turntable located at the upper surface of the top plate, the turntable being rotatable relative to the top plate about a third rotation axis extending substantially perpendicular to the top plate upper surface.

The present invention preferably includes guide means for ensuring that the rotation axes of the upper and lower wedges stay in alignment relative to the top and base plates respectively. The guide means can include a respective projection of the top plate and base plate which engages an inside or outside diameter of the upper and lower wedge rings respectively. The projections preferably include rollers.

The present invention preferably includes respective rotation means between the base plate and lower wedge, between the lower wedge and upper wedge, and between the upper wedge and top plate, for allowing free rotation of the upper and lower wedges. In one embodiment, the rotation means includes a circular groove with ball bearings disposed in each groove. In another embodiment, the rotation means includes low friction pads. In another embodiment, the rotation means includes rollers.

The turntable also preferably includes the above guide means and rotation means.

The present invention also preferably includes locking means for locking the upper and lower wedges in their selected respective rotation positions relative to the top and base plates. Preferably, the lower wedge can be locked against rotation relative to the base plate. Preferably, the upper wedge can be locked against rotation relative to the top plate. Preferably, the lower and upper wedges can be locked against rotation relative to each other. The turntable can also be preferably locked against rotation relative to the top plate.

The present invention in another embodiment includes a first motor mounted on the base plate upper surface which engages the lower wedge for rotating the lower wedge. This embodiment also preferably includes a second motor mounted on the top plate lower surface which engages the upper wedge for rotating the upper wedge. This embodiment also preferably includes a third motor mounted on the top plate which engages the turntable for rotating the turntable. The first, second and third motors are preferably operable to substantially prevent rotation of the lower wedge, upper wedge and turntable respectively.

BRIEF DESCRIPTION OF THE DRAWINGS

Preferred forms of the present invention will now be described with reference to the accompanying drawings, wherein.

DETAILED DESCRIPTION OF THE PREFERRED EMBODIMENTS

Figure 1:
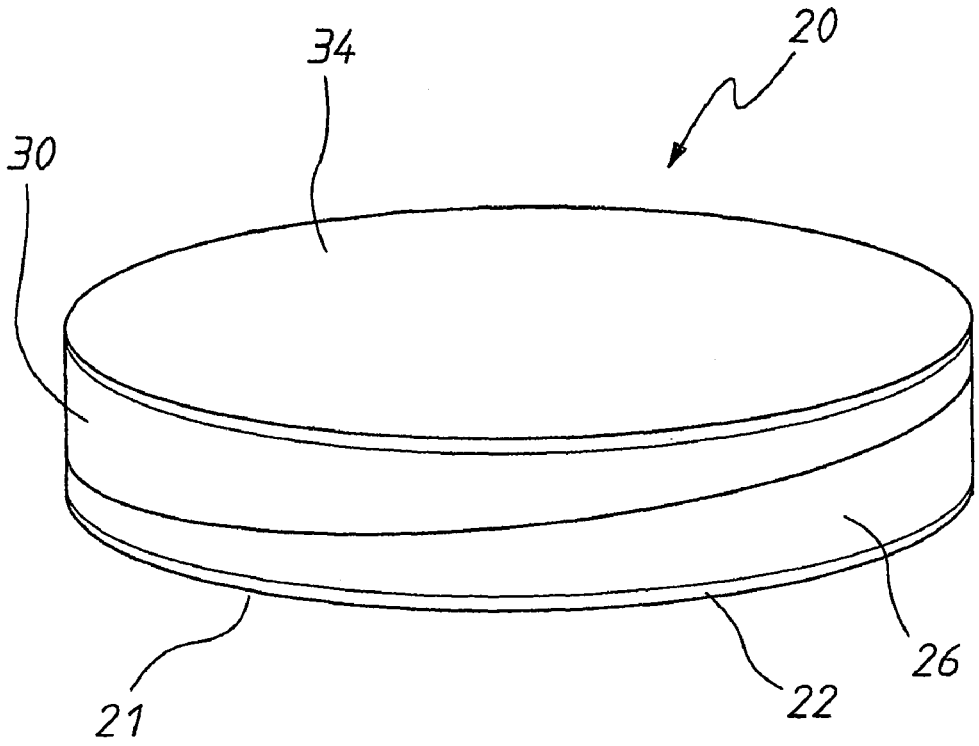
FIG. 1 shows an embodiment of the present invention.
Figure 2:
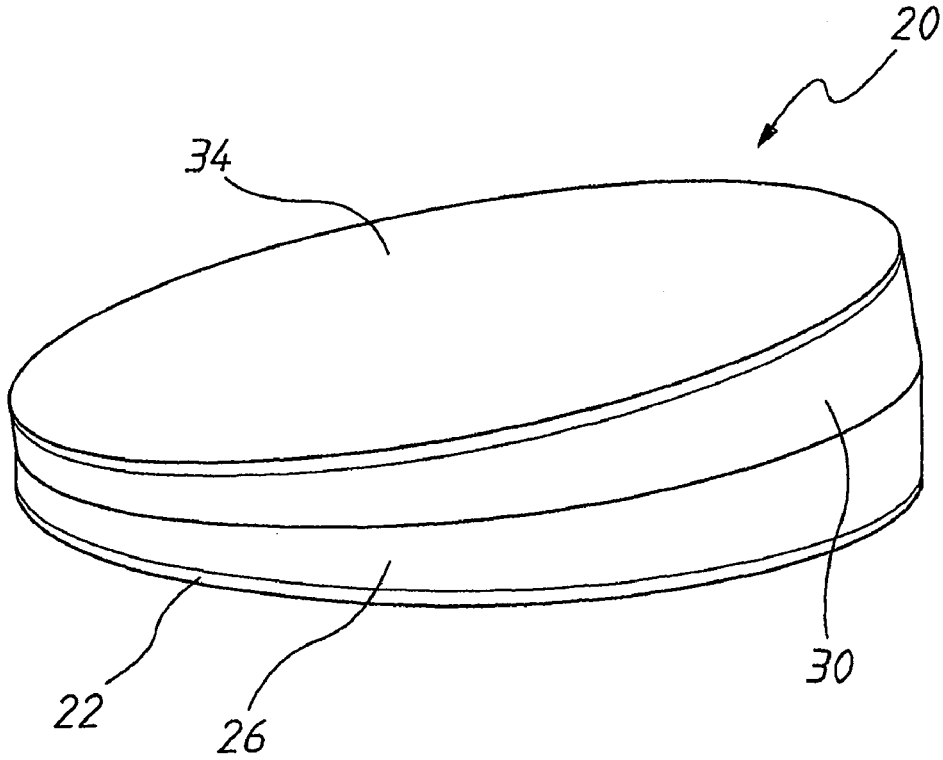
FIG. 2 shows the embodiment of FIG. 1 with the upper and lower wedges rotated to a first position.
Figure 3:
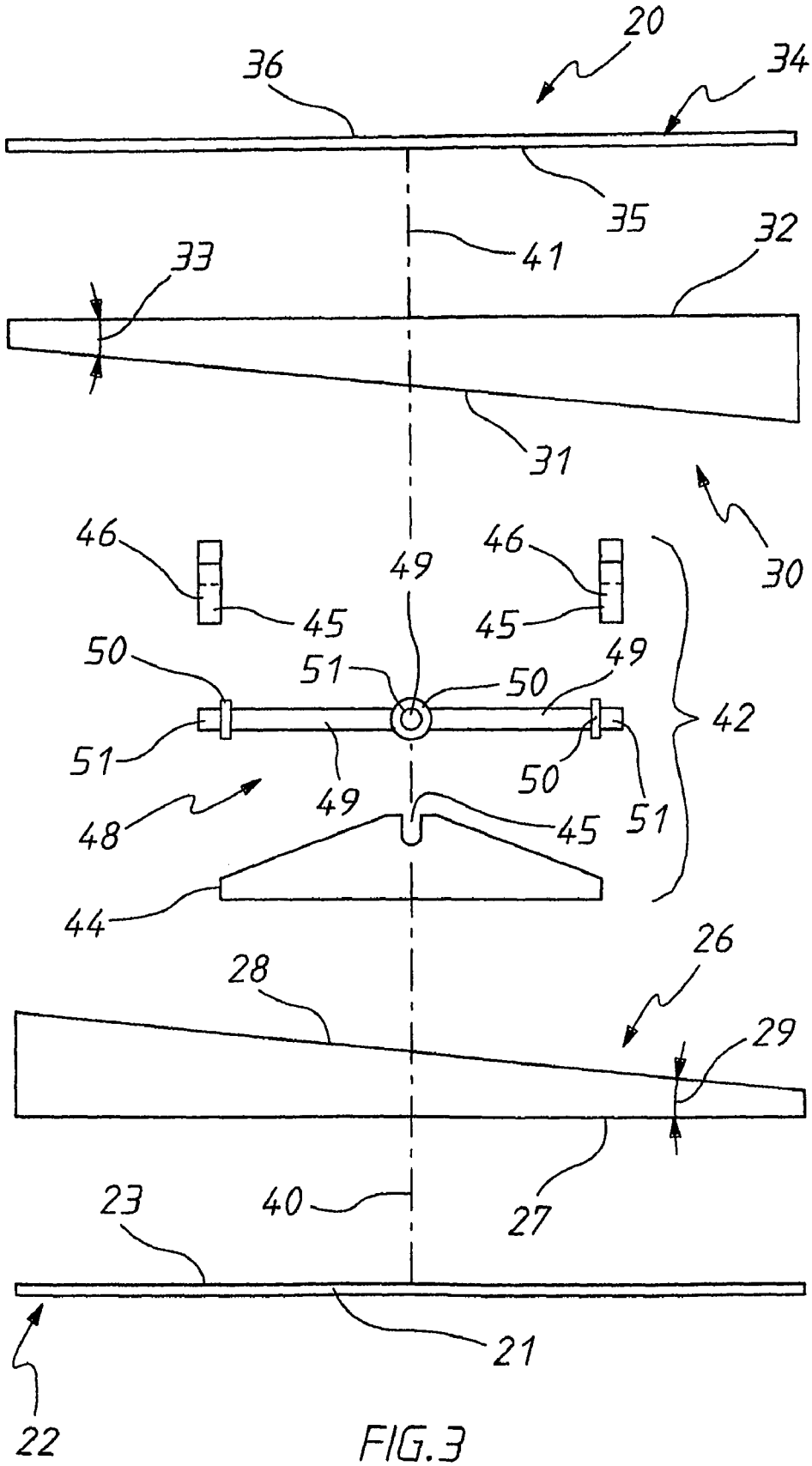
FIG. 3 shows an exploded view of the embodiment of FIG. 1.

FIGS. 1 to 3 show a golf driving range platform 20 according to the present invention. The platform 20 includes a circular base plate 22, a lower wedge 26, an upper wedge 30 and a circular top plate 34. The upper and lower wedges 26, 30 are hollow circular rings. The base plate 22, top plate 34 and upper and lower wedges 26, 30 are substantially similar in diameter.

Referring to FIG. 3, the base plate 22 has a lower surface 21 and an upper planar surface 23. The lower wedge 26 has a lower planar surface 27 and an upper planar surface 28 inclined relative to each other by a first angle 29. The lower wedge lower surface 27 is disposed above the base plate upper surface 23. The lower wedge 26 is rotatable relative to the base plate 22 about a first rotation axis 40 which extends substantially perpendicular to the base plate upper surface 23. The lower wedge lower surface 27 is substantially perpendicular to the first rotation axis 40 and the first rotation axis 40 is located at the center of lower wedge 26.

The upper wedge 30 has a lower planar surface 31 and an upper planar surface 32 inclined relative to each other by a second angle 33. The upper wedge lower surface 31 is disposed above the lower wedge upper surface 28 such that the upper wedge 30 is rotatable relative to the base plate 22 and the lower wedge 26. The top plate has a lower planar surface 35 and an upper surface 36. The top plate lower surface 35 is disposed above the upper wedge upper surface 32 such that the upper wedge 30 is rotatable relative to the top plate 34 about a second rotation axis 41 extending substantially perpendicular to the top plate lower surface 35. The upper wedge upper surface 32 is substantially perpendicular to the second rotation axis 41 and the second rotation axis 41 is located at the center of upper wedge 30.

Figure 4:
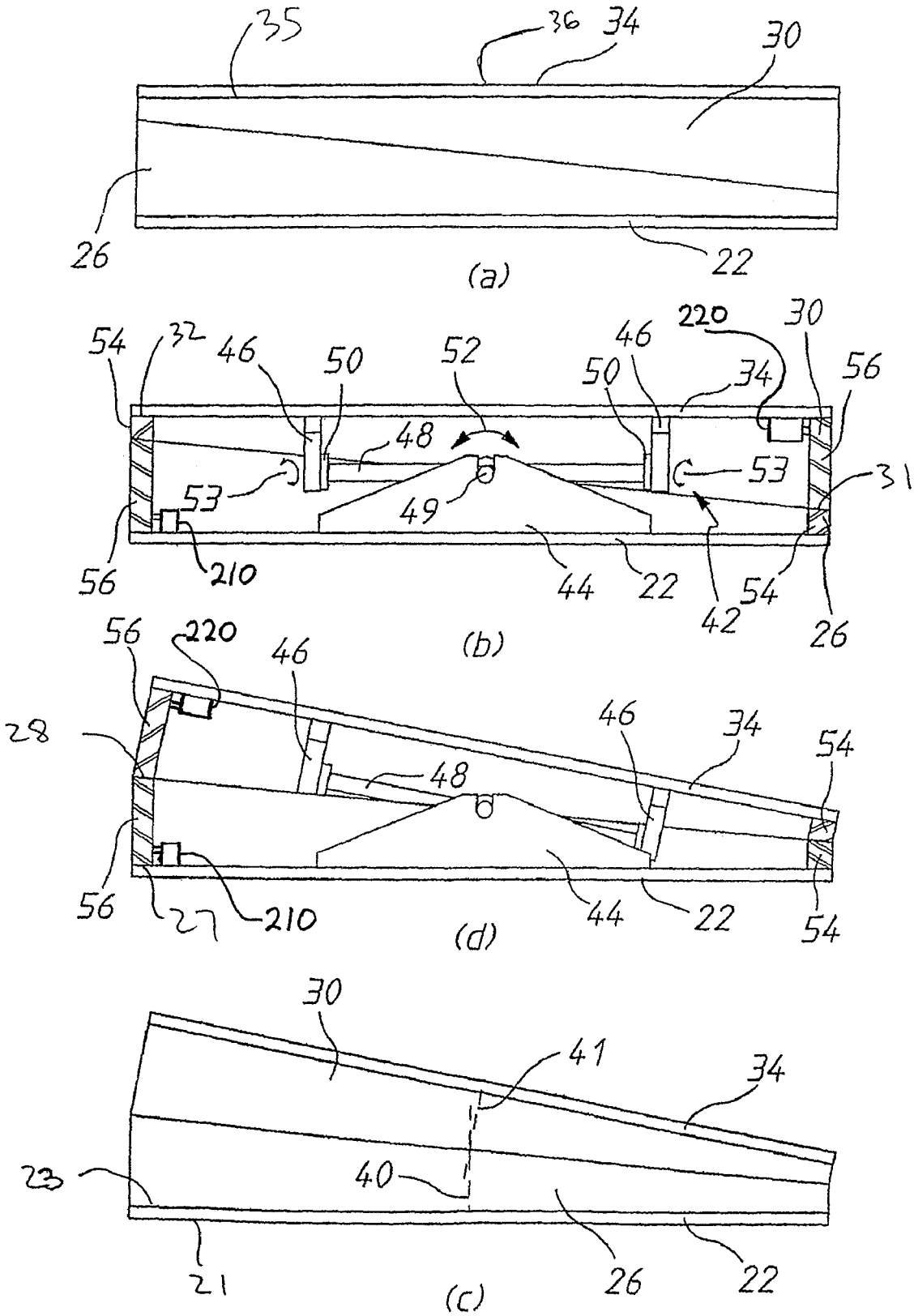
FIG. 4 (*a*) shows the embodiment of FIG. 1, (*b*) shows an inside view of FIG. 4(*a*), (*c*) shows the embodiment of FIG. 1 with the upper and lower wedges rotated to a first position, and (*d*) shows an inside view of FIG. 4(*c*)

In FIG. 3, the first and second rotation axes 40 and 41 are aligned as the base and top plates 22, 34 are parallel with each other. When the base and top plates 22, 34 are inclined relative to each other, the first and second rotation axes 40 and 41 are not aligned, but intersect at a mid-portion between the base and top plates 22, 34 (see. FIG. 4(*c*).

A joint 42 connects the top plate 34 to the base plate 22. The joint 42 includes two base plate supports 44 attached to the base plate upper surface 23, two top plate supports 46 attached to the top plate lower surface 35 and a cross member 48. The base plate supports 44 each include a notch 45 and are laterally spaced from each other at the base plate upper surface 23. The top plate supports 46 are identical to the base plate supports 44 and also include a notch 45. The top plate supports 46 are also laterally spaced from each other at the top plate lower surface 35, in a direction perpendicular to the lateral spacing of the base plate supports 44. The cross member 48 includes four identical arms 49 arranged in a cross formation, each arm 49 including a stop 50 adjacent an end portion 51 thereof.

FIGS. 4 (*a*) and (*b*) show the assembled joint 42. The end portions 51 of the cross member 48 are received in a respective notch 45 of the top and base plate supports 46 and 44. The stops 50 retain the cross member 48 to the supports 44, 46. The base plate supports 44 allow the cross member 48 to tilt relative to the base plate 22 in the left to right direction, as indicated by arrow 52. Thus, the top plate 34 can tilt relative to the base plate 22 in the left to right direction. The top plate supports 46 allow the top plate 34 to tilt relative to the cross member 48 in the front to back direction, as indicated by arrows 53. Thus, the top plate 34 can tilt relative to the base plate 22 in the front to back direction. The joint 42 allows for a combination of the above left to right and front to back tilts of the top plate 34 relative to the base plate 22. The joint 42 also substantially prevents rotation of the top plate 34 relative to the base plate 22.

Independently of the above, the upper and lower wedges 30, 26 are rotatable relative to the base plate 22, the top plate 34 and relative to each other. The rotation positions of the upper and lower wedges 30 and 26 relative to the top plate 34 and relative to each other determines the amount of tilt and direction of tilt of the top plate 34 relative to the base plate 22.

Referring to FIGS. 4(*a*) to (*d*), the upper and lower wedges 30, 26 both include a narrow portion 54 and wide portion 56. The first and second angles 29 and 33 of the wedges 26 and 30 in the preferred embodiment are equal, which can be anywhere from 2° to 30°, as required. When the lower wedge narrow portion 54 is below the upper wedge wide portion 56, the top plate 34 is substantially parallel to the base plate 22 (FIG. 4(*b*)). When the lower wedge wide portion 56 is below the upper wedge wide portion 56, the top plate 34 is tilted relative to the base plate 22 (FIG. 4(*d*)) by an angle equal to the sum of the first and second wedge angles 29 and 33. By rotating the wedges 26 and 30 relative to each other, the top plate 34 can be tilted relative to the base plate 22 by an angle between 0° to a maximum of the sum of the first and second wedge angles 29 and 33. The direction of tilt of the top plate 34 can be changed by rotating the wedges 26 and 30 together, relative to the top plate 34. In the example of FIG. 4(*d*), the top plate 34 is tilted to the maximum angle in the left to right direction. The tilt direction can be reversed to the right to left direction by rotating the wedges 26 and 30 together by 180° relative to the top plate 34.

The base plate 22 can include rubber feet at its lower surface 21. The top plate 34 can include a non-slip material and a material simulating grass (golf mat) at its upper surface 36. In use, the platform 20 is typically mounted in a golf driving range bay. A golfer will stand on the golf mat above the top plate upper surface 36 and hit golf balls therefrom. The golfer can then change the tilt and tilt direction of the top plate 34 by rotating the upper and lower wedges 30, 26 as required. As the top plate 34 does not rotate, a golfer does not have to rearrange the general direction of his/her stance when changing the tilt/tilt direction of the top plate 34. The golf mat on the upper surface 36 which can have a specific tee portion also does not rotate relative to the golf driving bay.

Figure 5:
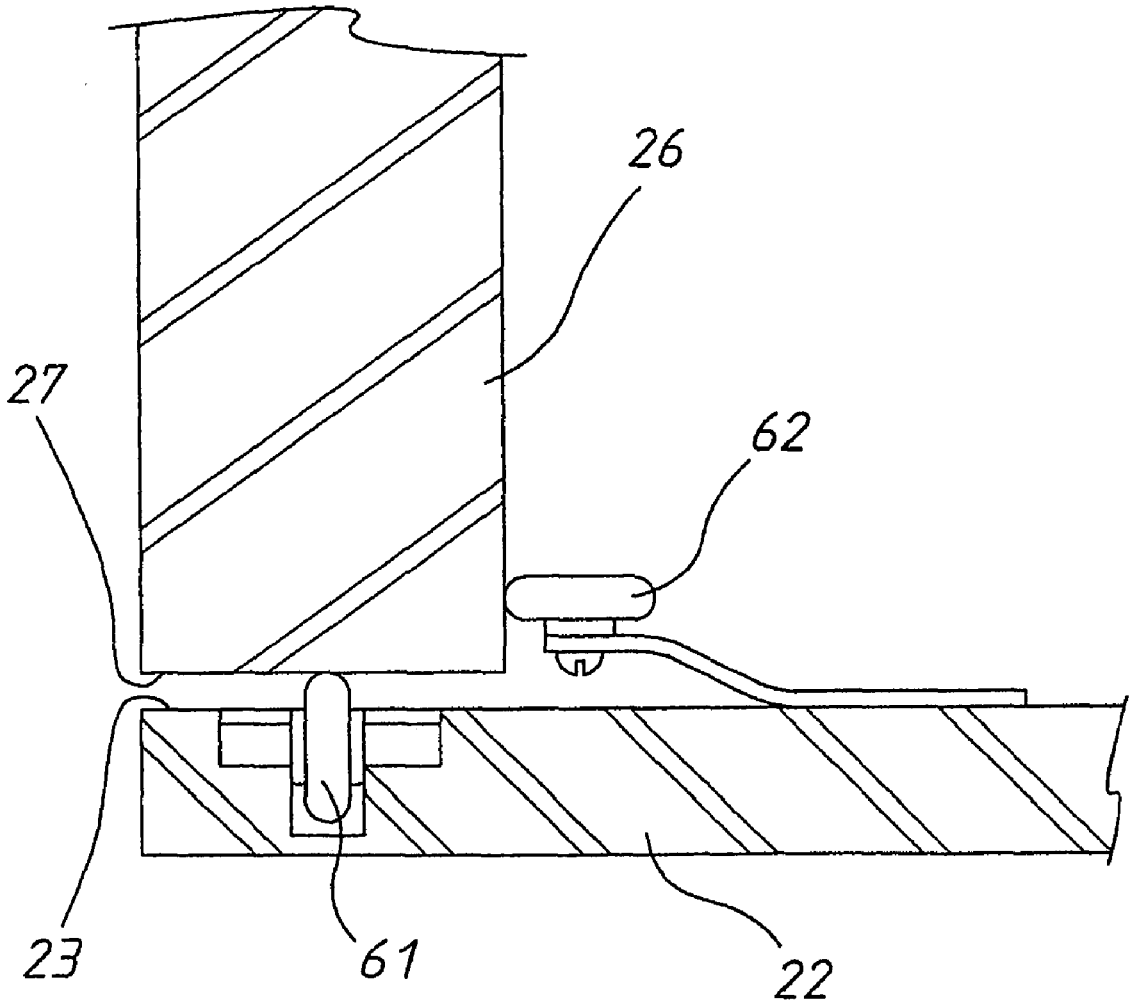
FIG. 5 shows rollers between the base plate and the lower wedge for guiding and allowing free rotation of the lower wedge.

FIG. 5 shows a roller 61 between the base plate 22 and the lower wedge 26 for allowing free rotation of the lower wedge 26. A number of rollers 61 is distributed adjacent the circumference of the base plate 22. Similar rollers 61 can also be arranged between the lower and upper wedges 26, 30, and between the upper wedge 26 and top plate 34. A number of guide rollers 62 is also distributed adjacent the circumference of the base plate 22, with the rollers 62 engaging the inside diameter surface of the wedge ring 26 for maintaining the wedge ring 26 in place. Similar roller 62 can also be arranged adjacent the circumference of the top plate 34 for engaging the inside diameter surface of the wedge ring 30 for maintaining the wedge ring 30 in place. The rollers 62 thus ensure that the rotation axes of the wedges 26 and 30 remain aligned relative to the base and top plates 22 and 34 respectively.

Figure 6:
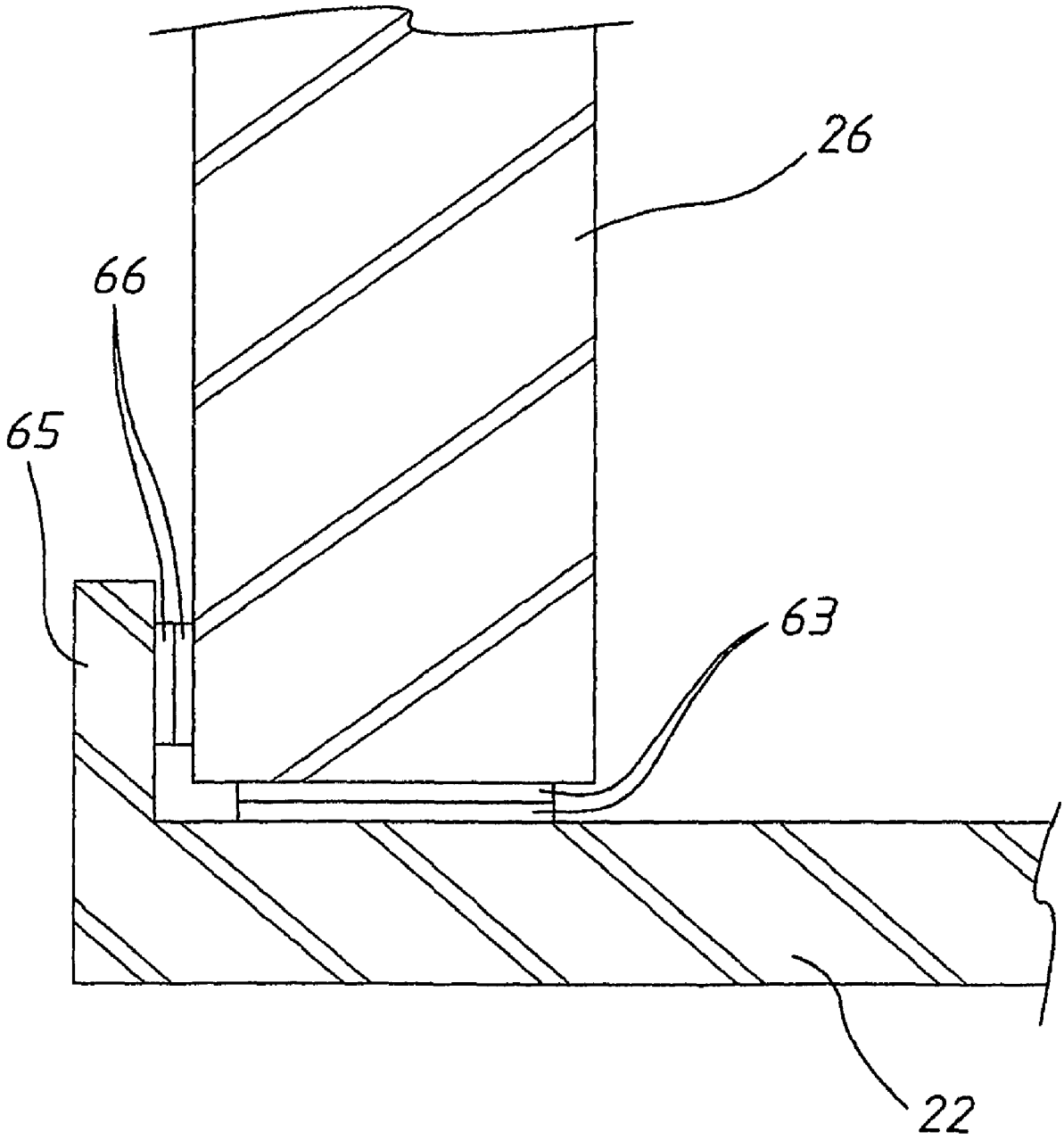
FIG. 6 shows low-friction pads between the base plate and the lower wedge for guiding and allowing free rotation of the lower wedge.

FIG. 6 shows an alternative to the roller of FIG. 5, using low-friction pads 63 between the base plate 22 and the lower wedge 26 for allowing free rotation of the lower wedge. The pads 63 extend adjacent the circumference of the base plate 22 and around the lower wedge lower surface 25. Similar pads can also be arranged between the lower and upper wedges 26, 30, and between the upper wedge 30 and top plate 34. In this embodiment, the base plate 22 also includes a perpendicular projection 65 which carries a low-friction pad 66 for engaging a low-friction pad 66 attached to the outside diameter of the lower wedge 26. The projection 65 thus maintains the wedge 26 in place. A similar projection 65 with pads 66 can also be arranged between the top plate 34 and upper wedge 30. Alternatively to the above, the projections can be provided adjacent the inside diameters of the wedges 26, 30.

Figure 7:
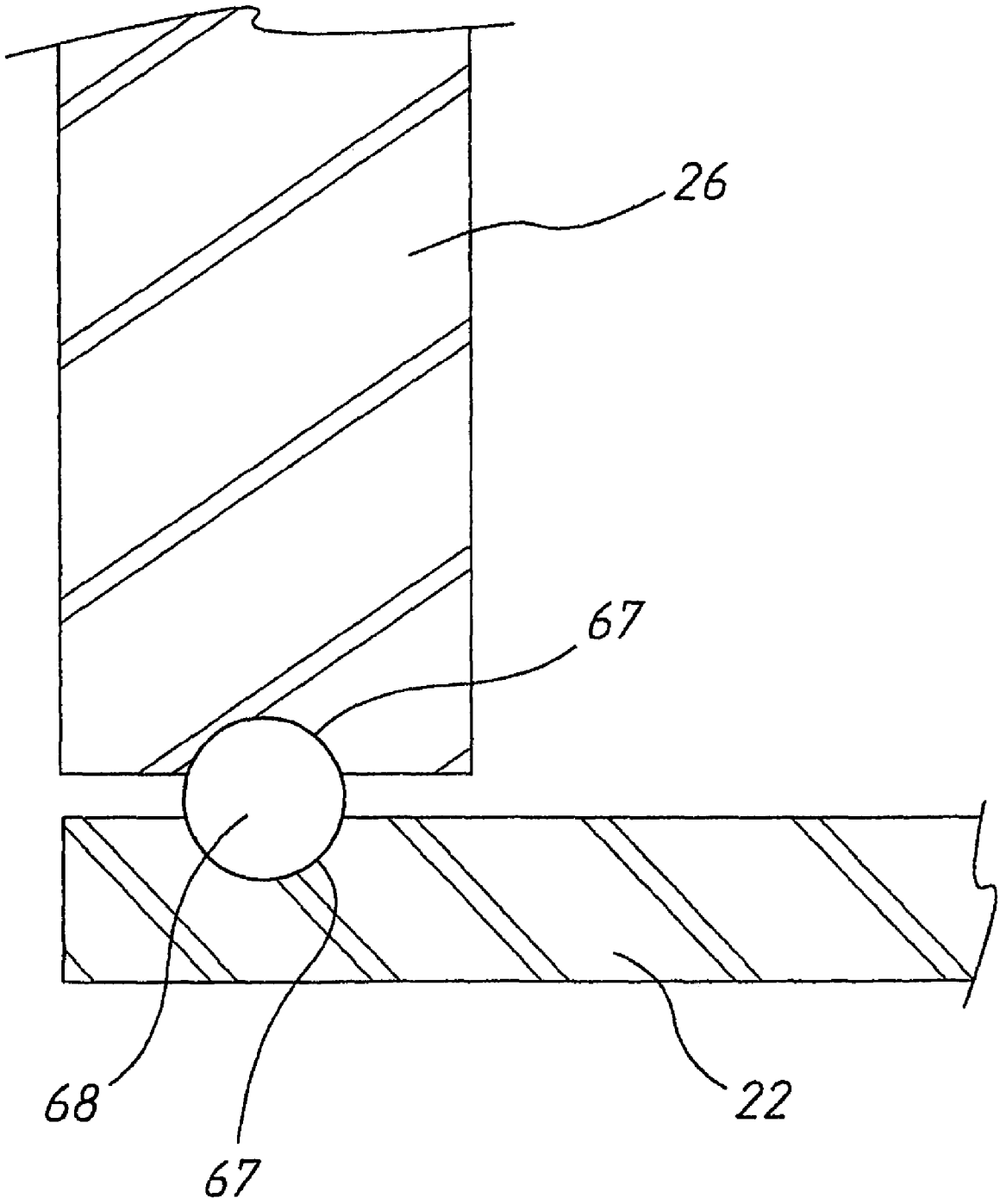
FIG. 7 shows recesses and a ball bearing between the base plate and the lower wedge for guiding and allowing free rotation of the lower wedge.

FIG. 7 shows another alternative, using recesses 67 and a ball bearing 68 between the base plate 22 and the lower wedge 26 for guiding and allowing free rotation of the lower wedge 26. Similar recesses 67 and bearings 68 can also be arranged between the lower and upper wedges 26, 30, and between the upper wedge 30 and top plate 34. In this embodiment, the recesses 67 and bearings 68 maintains the wedge 26, 30 in place and also allows rotation of same.

Figure 8:
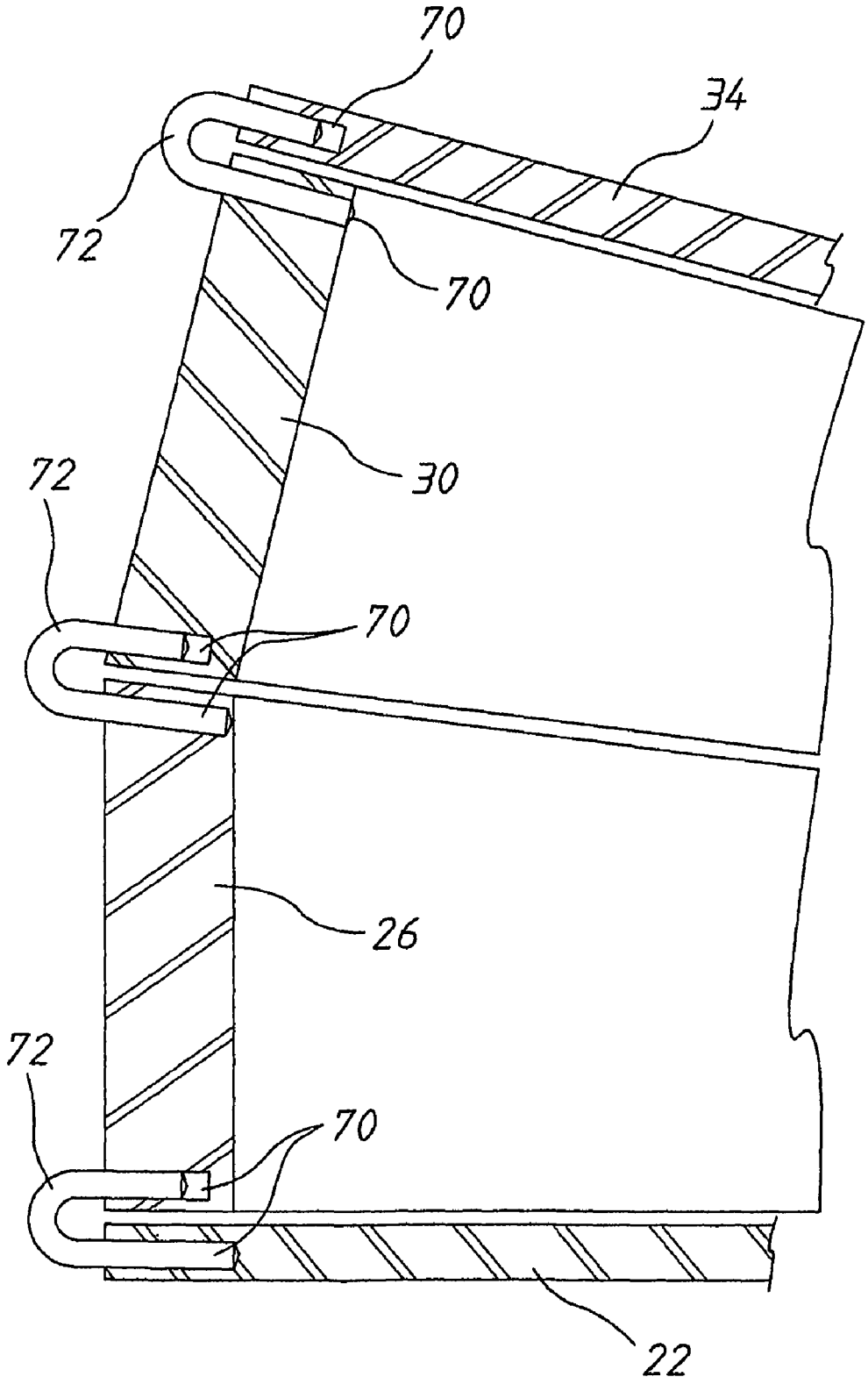
FIG. 8 shows apertures and pins between the base plate and lower wedge, between the lower wedge and upper wedge, and between the upper wedge and top plate for locking the respective parts in place relative to each other.

In the preferred embodiment, referring to FIG. 8, the platform 20 can include a number of apertures 70 spaced around the circumference of the base plate 22, wedges 26 and 30 and top plate 34. A number of U-shaped pins 72 can then be inserted into adjacent apertures 70 to lock the upper and lower wedges 30, 26 in their selected respective rotation positions relative to the top and base plates 34, 22. Thus, the lower wedge 26 can be locked against rotation relative to the base plate 22. Also, the upper wedge 30 can be locked against rotation relative to the top plate 34. Further, the lower and upper wedges 26, 30 can be locked against rotation relative to each other.

Figure 9:
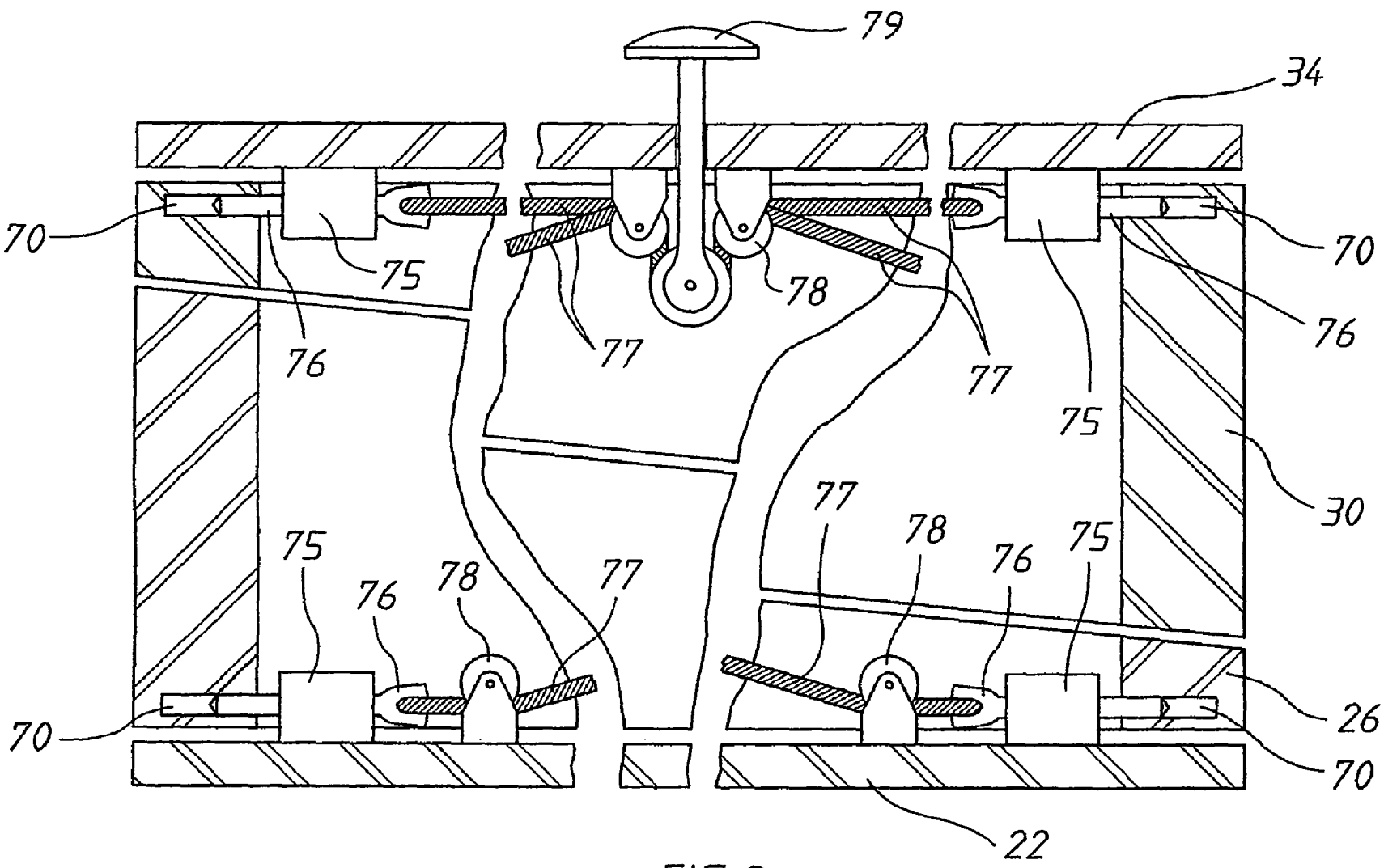
FIG. 9 shows apertures and pins between the base plate and lower wedge, and between the upper wedge and top plate, with a manual pin release assembly for selectively locking and unlocking the respective parts.

FIG. 9 shows an alternative to the locking means of FIG. 8. In this embodiment, the top and bottom plates 34, 22 are each provided with a housing 75 which biases pins 76 into apertures 70 of the upper and lower wedges 30, 26. The pins 76 are connected by ropes 77 and pulleys 78 to an actuator 79 which extends above the top plate 34. A downward force on the actuator 78 removes the pins 76 from engagement with the apertures 70 and thus unlocks the wedges 26, 30 from the lower and upper plates 22, 34. In this embodiment, a user can use his/her weight to adjust the tilt and tilt direction of the top plate 34 when the pins 76 are not engaged with the apertures 70. An alternative to this embodiment is the use of friction brakes (not shown) which engage an inside diameter of the upper and lower wedges 30, 26, instead of pins 76, for infinite adjustment of the upper and lower wedges 30, 26. These embodiments can also include the FIG. 8 apertures 70 and pin 72 for locking the upper and lower wedges 30, 26 to each other.

In another embodiment, electronically controlled actuators can be used to engage/disengage the pins or fiction brakes. Such actuators can be electric, pneumatic or otherwise. The actuators can be used to disengage the upper and lower wedges 30, 26 from the top and bottom plates 34, 22, with the wedges 30, 26 locked with each other. The user can then use his/her weight to lean on portions of the top plate 34 to rotate the wedges 30, 26 together to change the tilt direction of the top plate 34. Once the desired tilt direction is achieved, the actuators can then be activated to engage and lock the wedges 30, 26 in position relative to the top and bottom plates 34, 22.

In another embodiment (see FIG. 4), the platform 20 includes a first motor 210 mounted on the base plate upper surface 23 which engages the lower wedge 26 for rotating same. A second motor 220 is also mounted on the top plate lower surface 35 which engages the upper wedge 30 for rotating same. The first and second motors 210, 220 are also operable to substantially prevent rotation of the lower wedge and upper wedge 22, 34. The first and second motors 210, 220 can engage the wedges 26, 30 by any known means, such as by friction or rack (carried by the wedges 26, 30) and pinion (carried by the motors).

Figure 10:
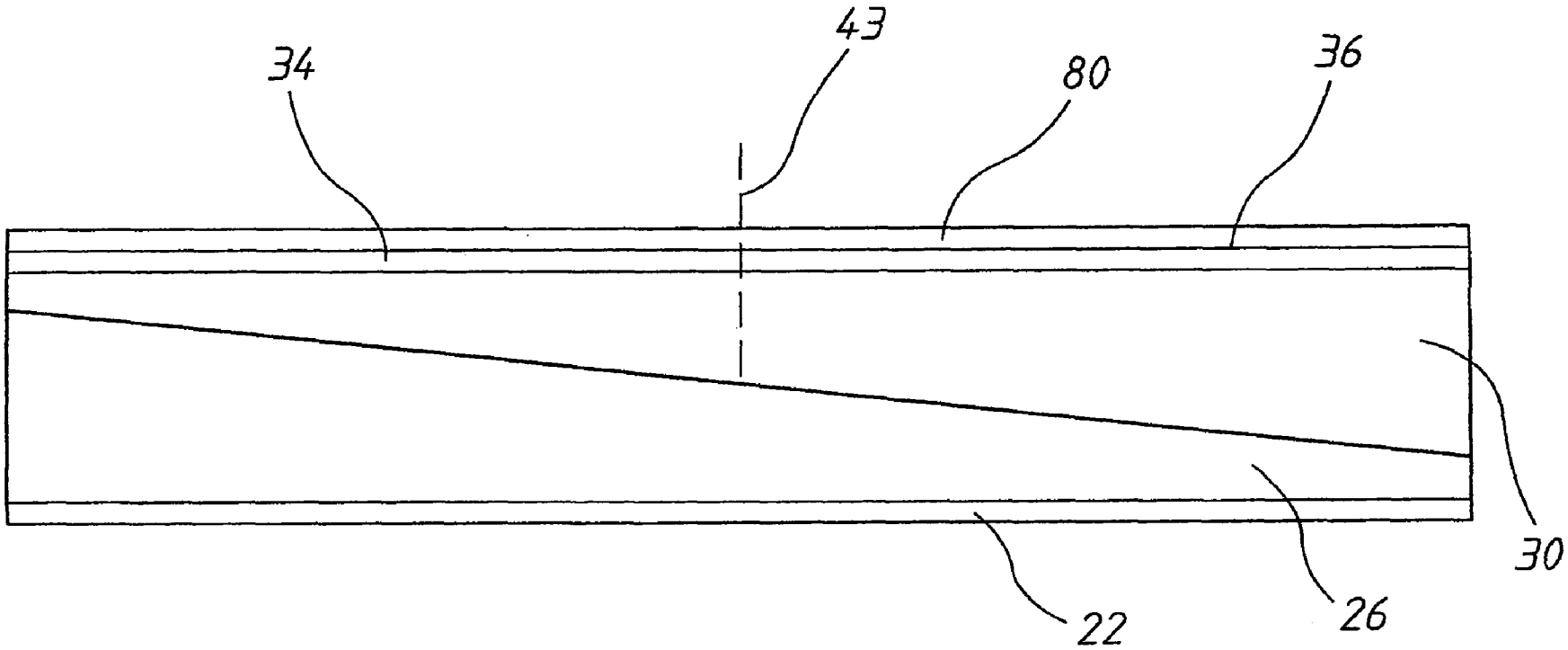
FIG. 10 shows the embodiment of FIG. 1 with a turntable.
Figure 11A:
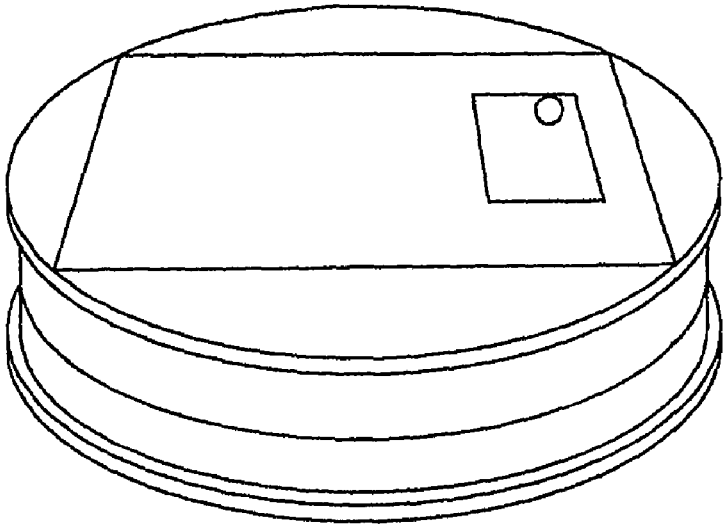
FIG. 11 shows various rotation positions of the upper and lower wedges of the embodiment of FIG. 1, to provide (a) flat lie, (b) 50% slope, downhill lie, (c) 100% slope, downhill lie, (d) 100% slope, right to left crossfall, (e) 100% slope, uphill lie, and (f) 100% slope, left to right crossfall.
Figure 11B:
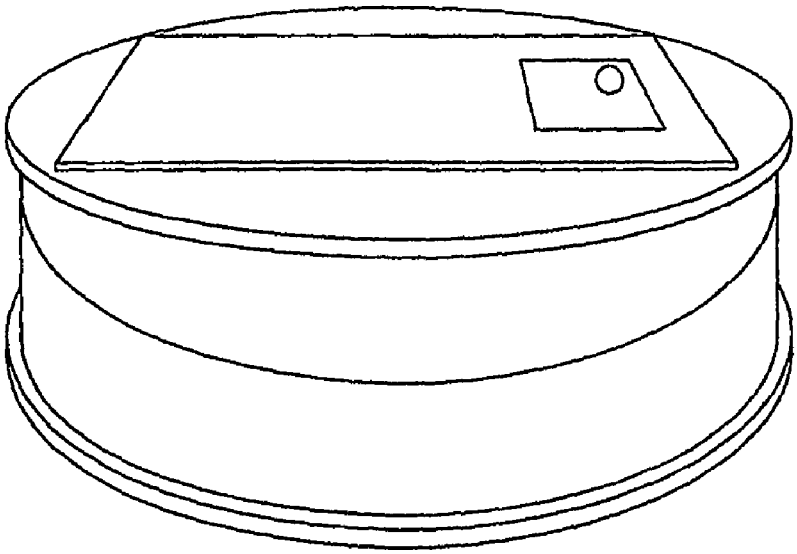
Figure 11C:
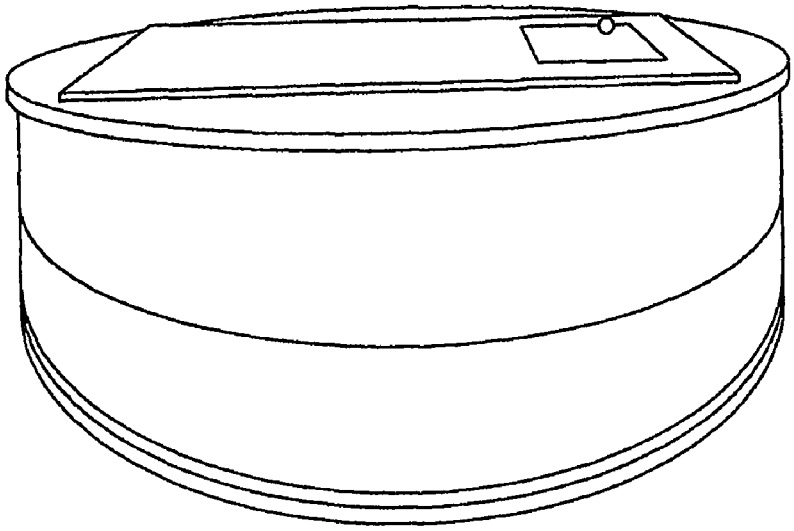
Figure 11D:
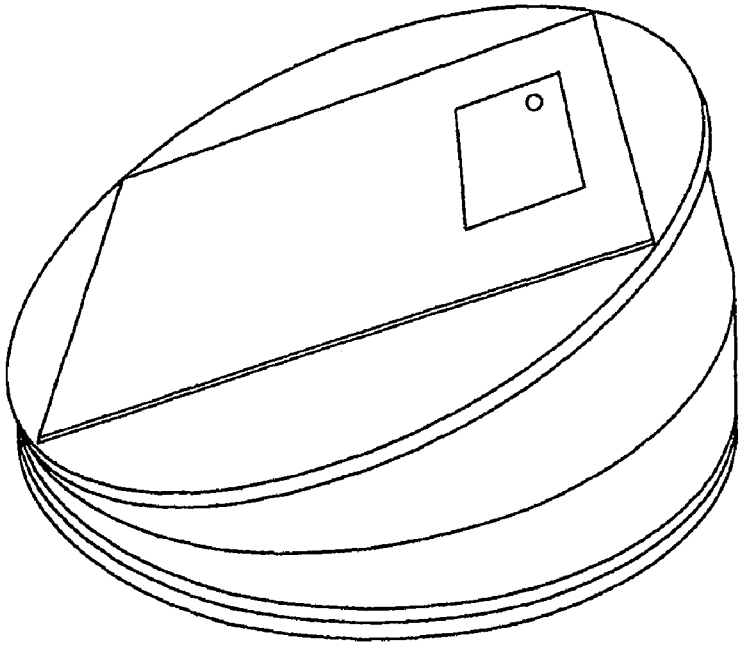
Figure 11E:
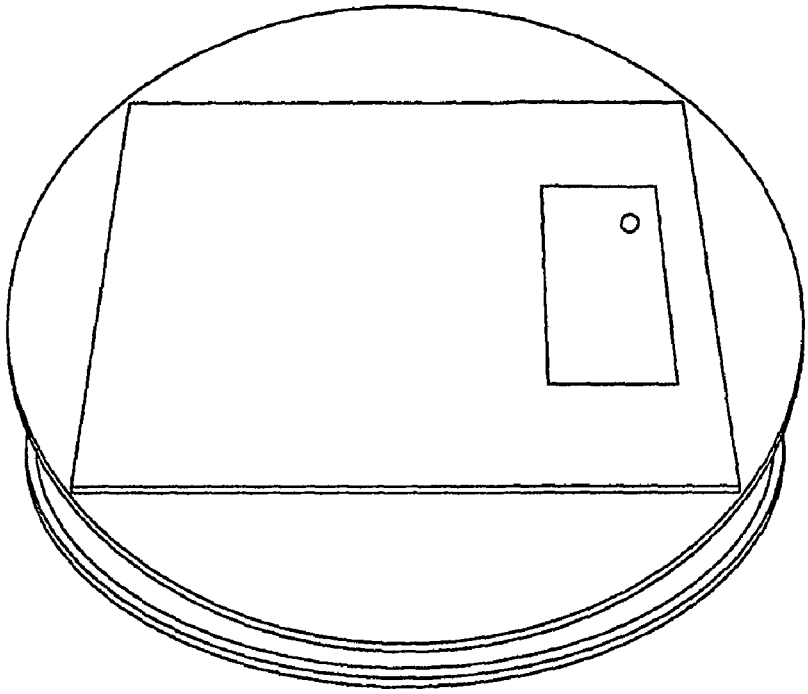
Figure 11F:
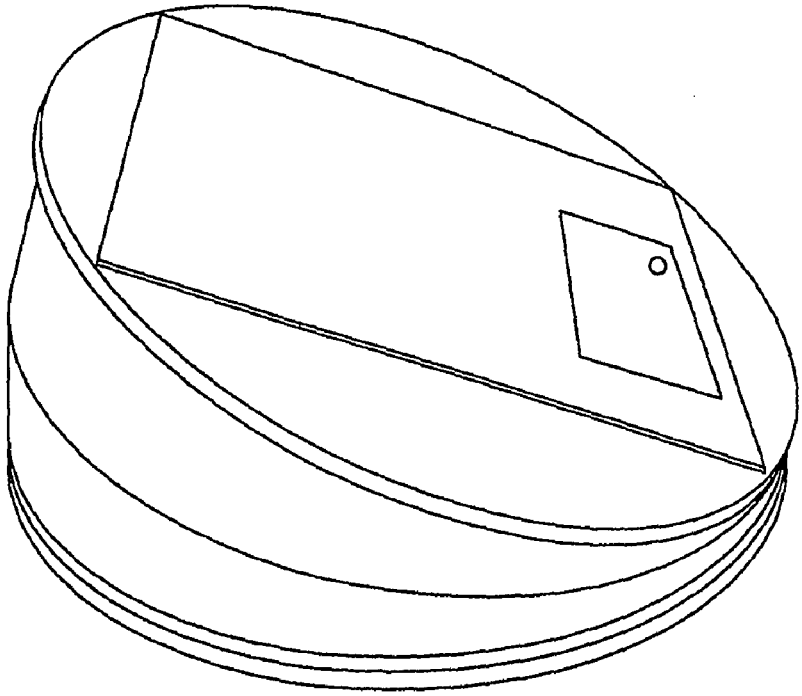

FIG. 10 shows the platform 20 with a turntable 80 located at the upper surface 36 of the top plate 34. The turntable 80 is rotatable relative to the top plate 36 about a third rotation axis 43 which extends substantially perpendicular to the top plate upper surface 36. The turntable preferably includes the above guide means and rotation means, such as the rollers 61 and 62, pads 63 or 65, or grooves and bearings 67, 68 to allow rotation of the turntable 80 and maintain same in place. The platform can also include a third motor which engages the turntable for rotating the turntable. The turntable is useful for when the platform 20 is used as a display platform, rather than a golf platform.

The present invention thus provides a golf platform which allows a golfer to vary the slope and direction of slope of the golf ball hitting surface. FIGS. 11 (*a*) to (*f*) shows various slope and slope directions possible for the platform 20, with a non-slip mat, a pad simulating grass and a golf ball located above the top plate 34 for illustration purposes. It can be seen that in the present invention, as the top plate does not rotate, a golfer does not need to rotate his general stance direction, or the golf mat direction, when changing the slope and slope direction of the top plate.

Figure 12:
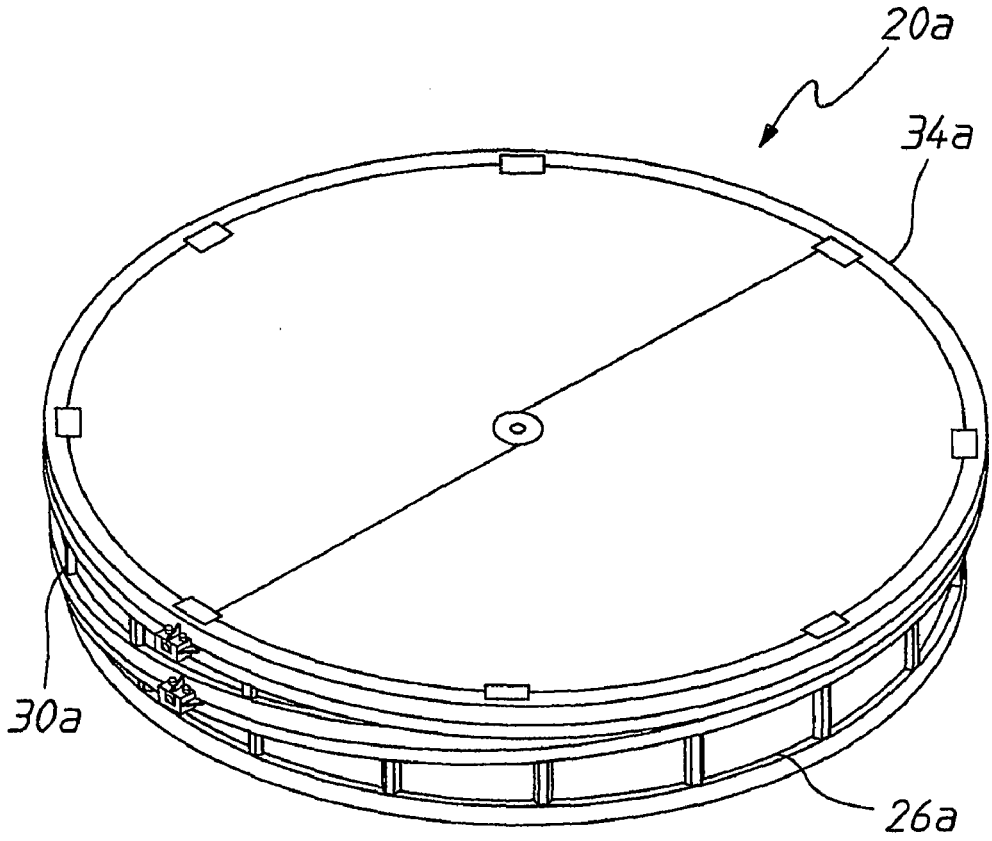
FIG. 12 shows a modified embodiment of the present invention.
Figure 13:
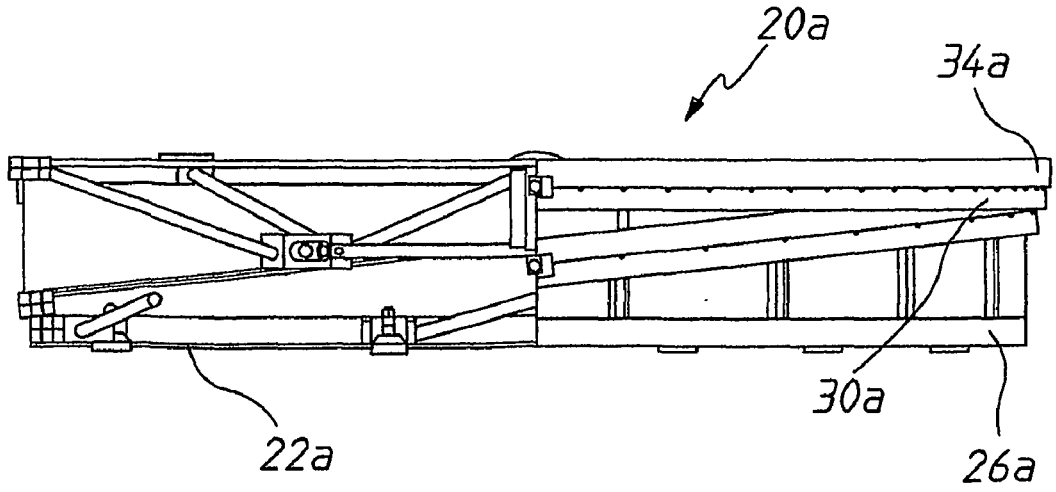
FIG. 13 shows a part cross-section front view of the embodiment of FIG. 12.

FIGS. 12 and 13 show a modified golf driving range platform 20*a*, which is similar to the platform 20. Components of the platform 20*a* which are similar to and have the same function as those of the platform 20 will be indicated with the same reference numerals but including the suffix "a". The platform 20*a* includes a circular base plate 22*a*, a lower wedge 26*a*, an upper wedge 30*a* and a circular top plate 34*a*. The function of the platform 20*a* is the same as that of the platform 20.

Referring to FIG. 14, the top plate 34*a* includes a deck 101 and a deck support 102. The deck 101 consists of two connected half-circular panels 103 made from exterior grade plywood. The panels 103 together form the top plate upper surface 36*a*.

Figure 14A:
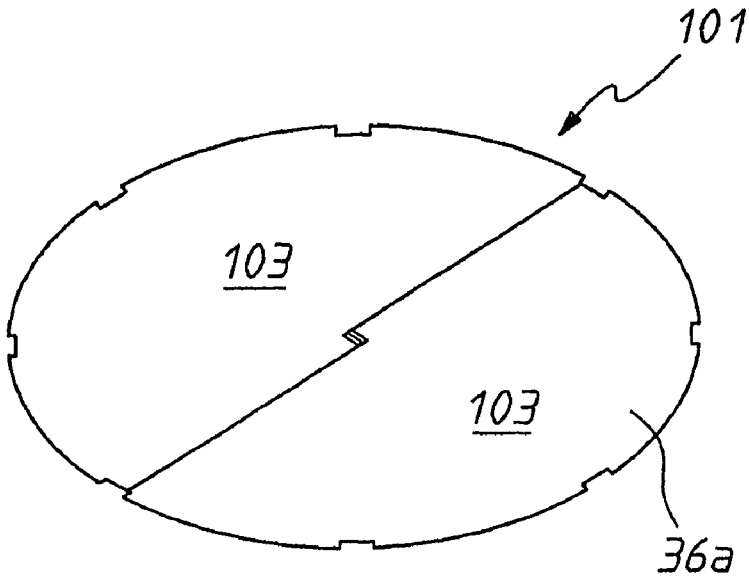
FIG. 14 shows (a) perspective view of a deck, (b) perspective view of a deck support, (c) elevation view of the deck support and (d) cross-section view of the deck support ring along line d-d, of a modified embodiment of the top plate for the embodiment of FIG. 12.
FIG. 14*e* shows a pin lock for the deck support.
Figure 14B:
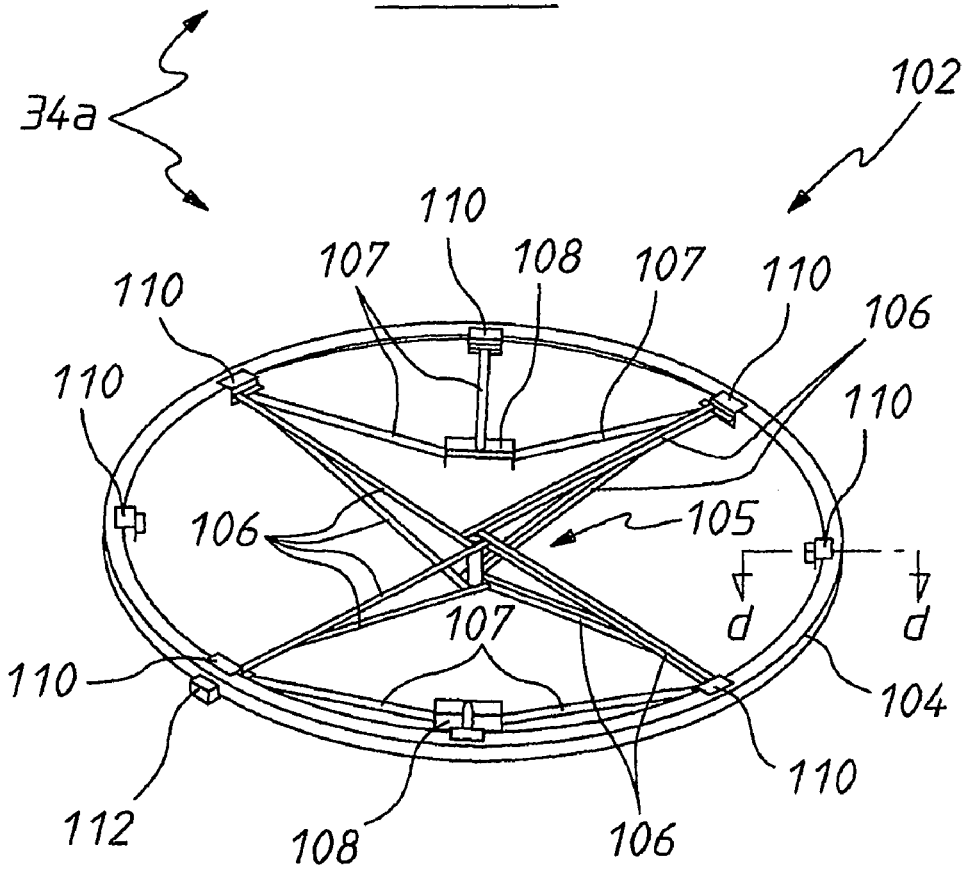
Figure 14E:
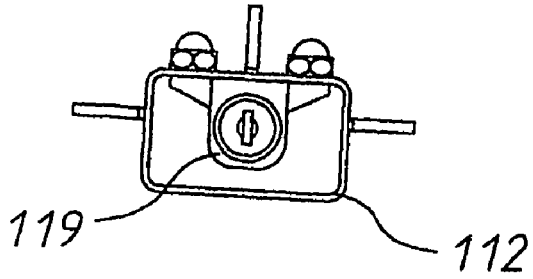
Figure 14D:
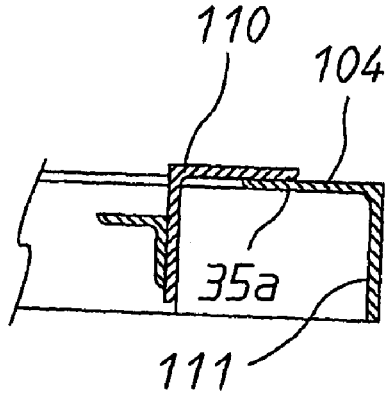
Figure 14C:
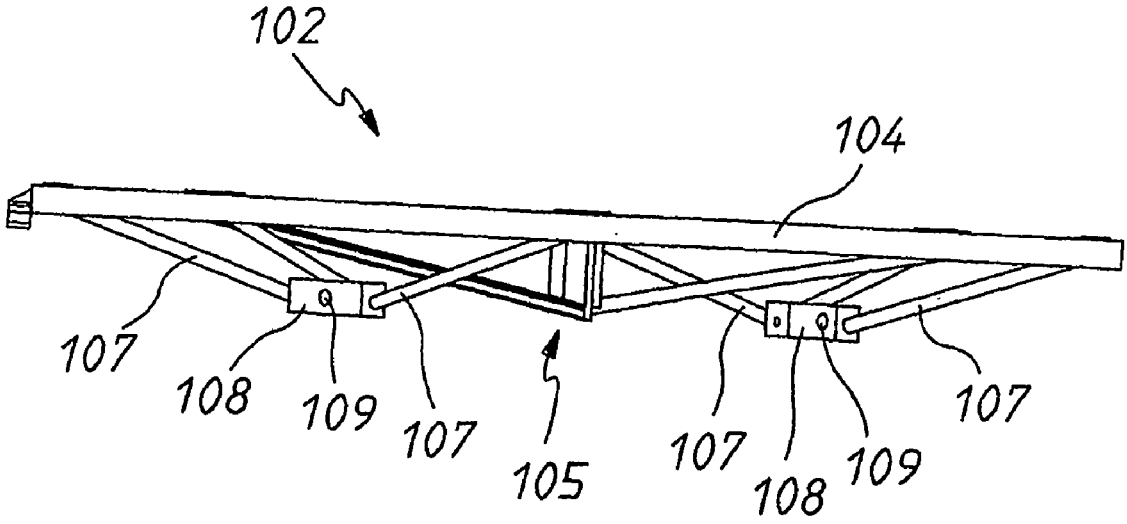
Figure 15A:
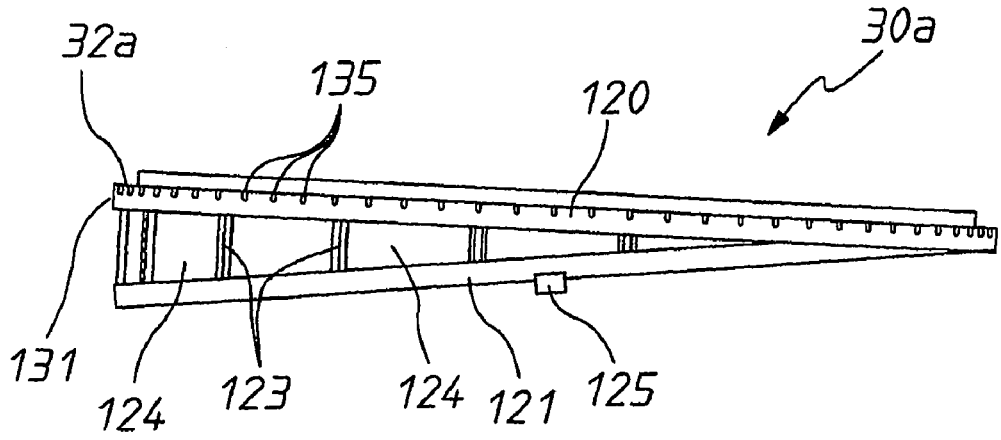
FIG. 15 shows (a) elevation view, (b) perspective view and (c) enlarged part cross-sectional view along line c-c of a modified embodiment of the upper wedge for the embodiment of FIG. 12.
FIG. 15*d* shows a pin lock for the upper wedge.
Figure 15B:
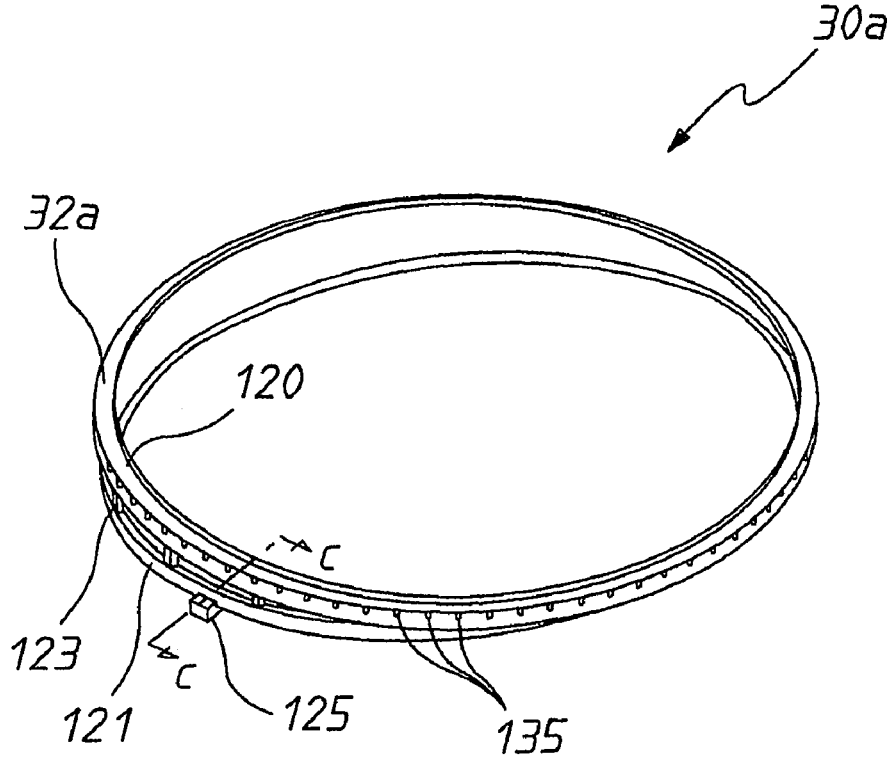
Figure 15C:
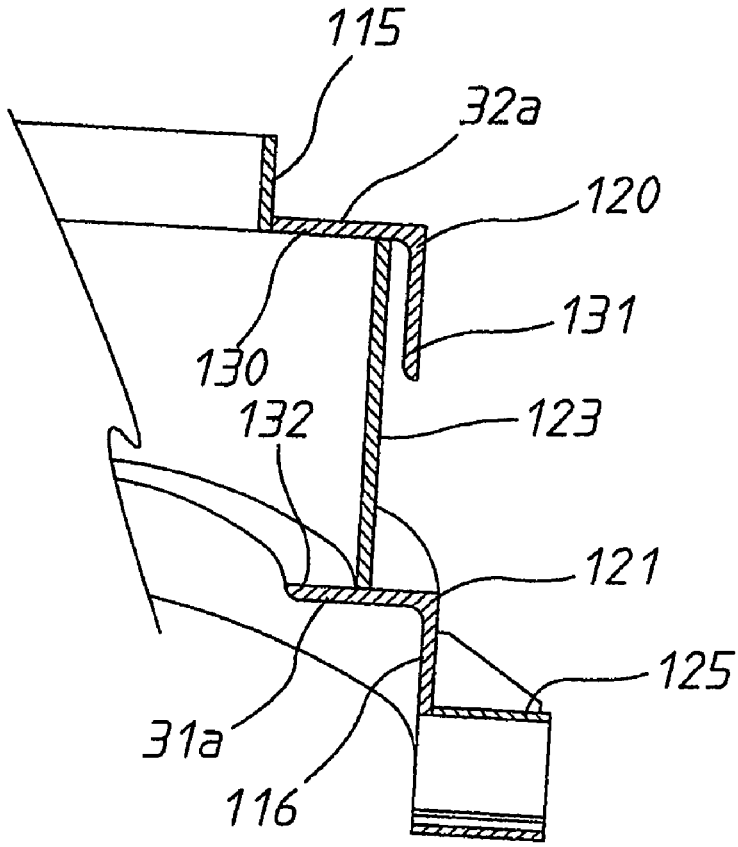
Figure 15D:
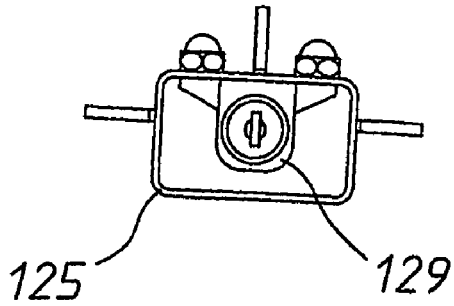

The deck support 102 includes a ring 104 and reinforcing frame 105. The frame 105 includes members 106 extending toward the middle of the ring 104. Ledge portions 110 are disposed around the ring 104 (see FIG. 14*d*, which is a cross-section of the ring 104 and a ledge portion 110). Extending inwardly and downwardly from the ring 104 are supports 107 for universal joint mounts 108. Two diametrically opposite mounts 108 are attached to the ring 104, each mount 108 having an aperture 109. The deck panels 103 rest on the ledge portions 110 and frame 105 when assembled, which support the weight of a user standing on the deck 101 in use. The ring 104 includes a lower surface 35*a* and an inwardly facing bearing surface 111 (see FIG. 14*d*) adjacent and perpendicular thereto. The ring also includes a pin lock mount 112 at one location thereof. FIG. 14*e* shows a pin lock 119 mounted in the mount 112. The lock 119 includes a pin which can be inserted into a hole 135 of the upper wedge 30*a*, as will be explained below.

In the embodiment, the ring 104 is 1.650 m in diameter.

FIG. 15 shows the upper wedge 30*a*, which is essentially a hollow circular ring. The upper wedge 30*a* consists of a first ring 120 which is connected to a second ring 121 by vertical supports 123. Sheets 124 are attached between the supports 123. Referring to FIG. 15*c*, the upper ring 120 in cross-section essentially includes a horizontal portion 130 forming the upper planar surface 32*a*, a first flange 115 extending upwardly from an inside periphery of the portion 130 and a second flange 131 extending downwardly from an outside periphery of the portion 130. The lower ring 121 in cross-section essentially includes a horizontal portion 132 forming a lower planar surface 31*a*, and a flange 116 extending downwardly from an outside periphery of the portion 132. As for the platform 20, the upper surface 32*a* and lower surface 31*a* are inclined relative to each other. The upper ring second flange 131 includes a number of spaced holes 135 around its periphery. The lower ring flange 116 includes a pin lock mount 125 at one location thereof. FIG. 15*d* shows a pin lock 129 mounted in the mount 125. The lock 129 includes a pin which can be inserted into a hole 165 of the lower wedge 26*a*, as will be explained below.

In the embodiment, the upper ring 120 is 1.636 m in diameter, the lower ring 121 is 1.625 m in diameter. There are 72 equally spaced holes 135 around the flange 131, each hole 135 being 10 mm wide.

FIG. 16 shows the lower wedge 26*a*, which is essentially a hollow circular ring, similar in construction to the upper wedge 30*a*. The lower wedge 26*a* consists of a first ring 140 which is connected to a second ring 141 by vertical supports 143. Sheets 144 are attached between the supports 143. Referring to FIG. 16*d*, the upper ring 140 in cross-section essentially includes a horizontal portion 150 forming the upper planar surface 28*a*, a first flange 155 extending upwardly from an inside periphery of the portion 150 and a second flange 161 extending downwardly from an outside periphery of the portion 150. The lower ring 141 in cross-section essentially includes a horizontal portion 152 forming a lower planar surface 27*a*, and a flange 156 extending downwardly from an outside periphery of the portion 152. As for the platform 20, the upper surface 28*a* and lower surface 27*a* are inclined relative to each other. The upper ring second flange 161 includes a number of spaced holes 165 around its periphery.

Figure 16A:
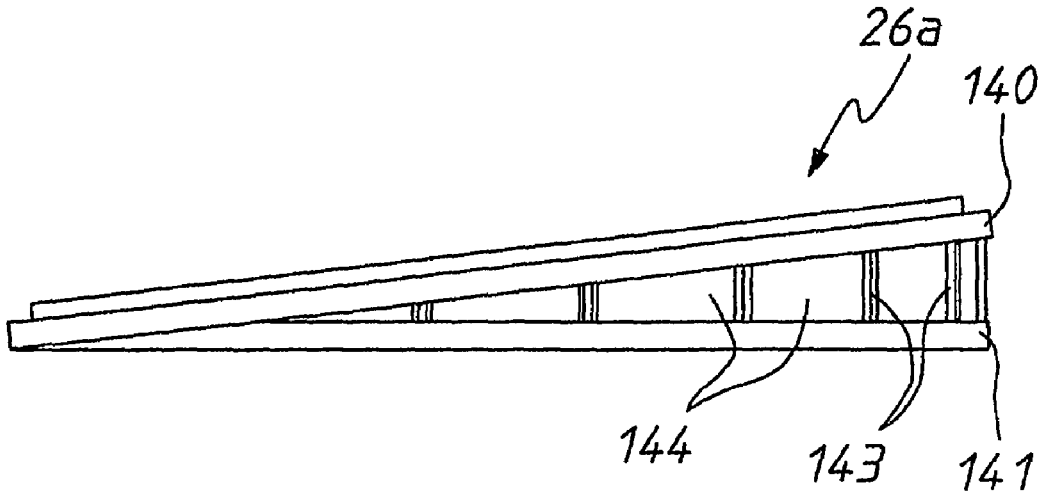
FIG. 16 shows (a) elevation view, (b) perspective view, (c) part plan view and (d) cross-section view along line d-d of a modified embodiment of the lower wedge for the embodiment of FIG. 12.
Figure 16B:
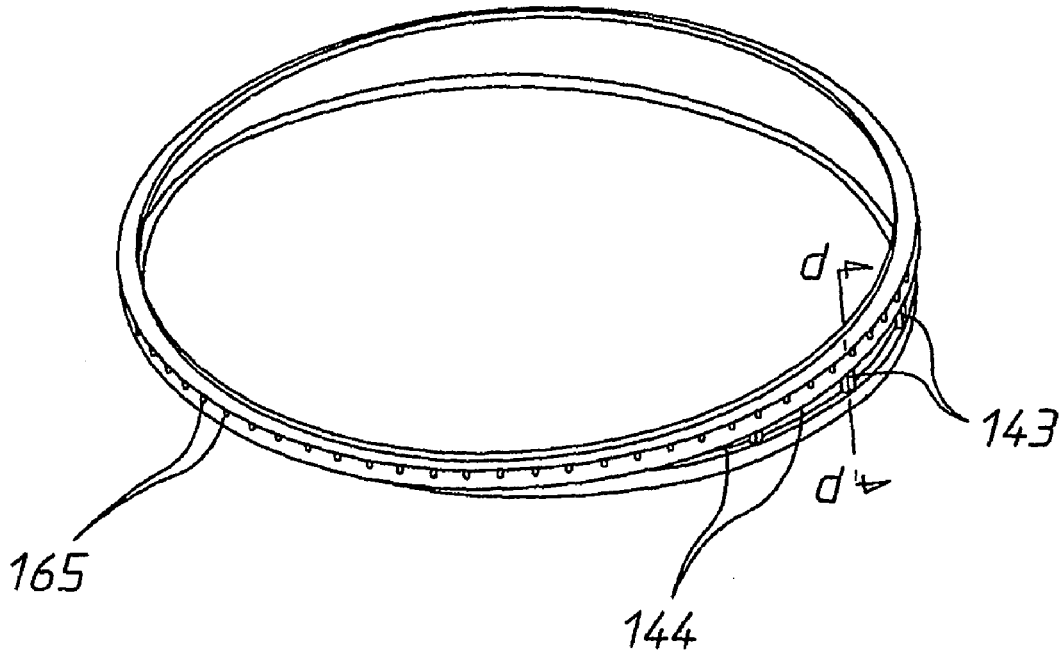
Figure 16C:
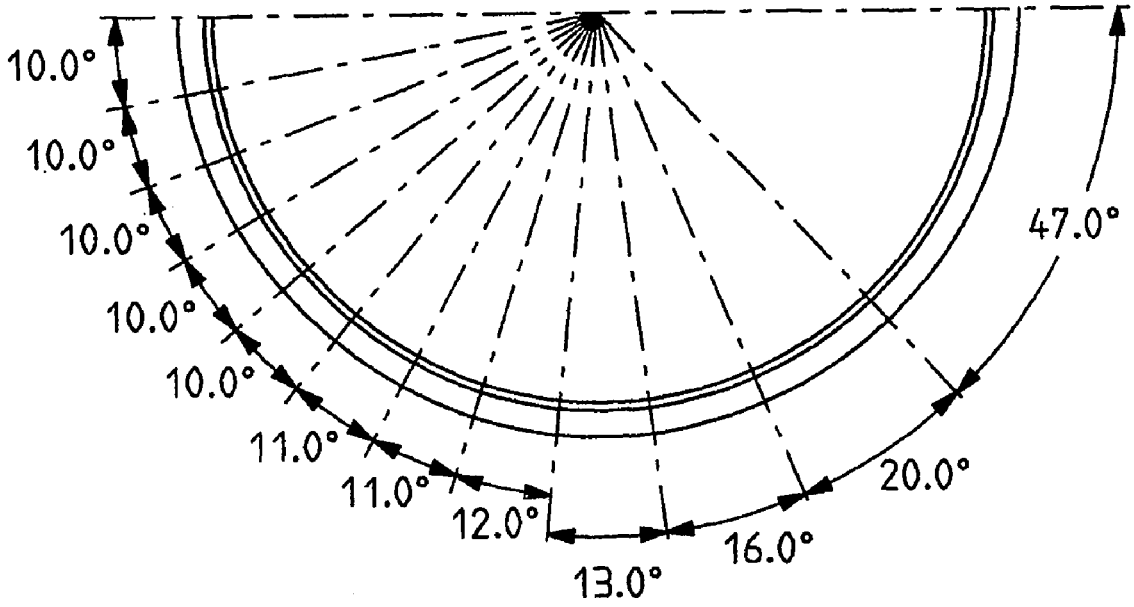
Figure 16D:
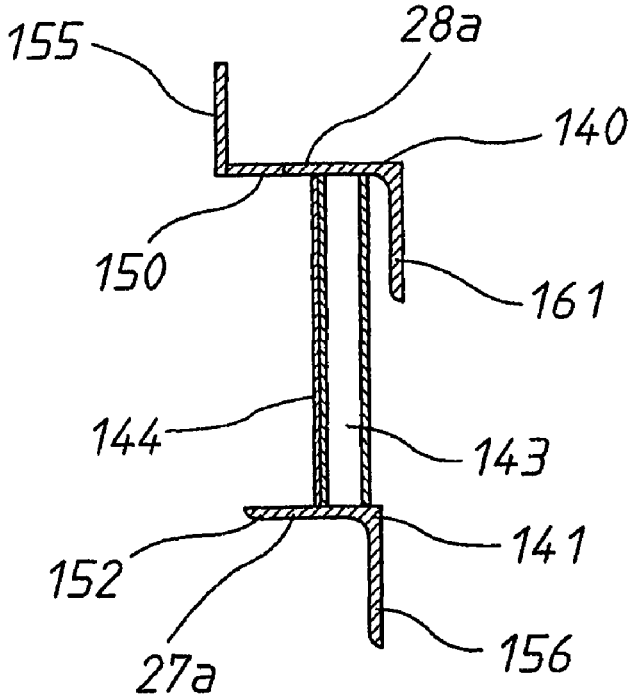

In the embodiment, the upper ring 140 is 1.610 m in diameter, the lower ring 141 is 1.582 m in diameter and there are 13 spaced holes 165 around the flange 161. FIG. 16*c* shows the angular spacing between the 13 holes 165, each hole 135 being 10 mm wide.

Figure 17A:
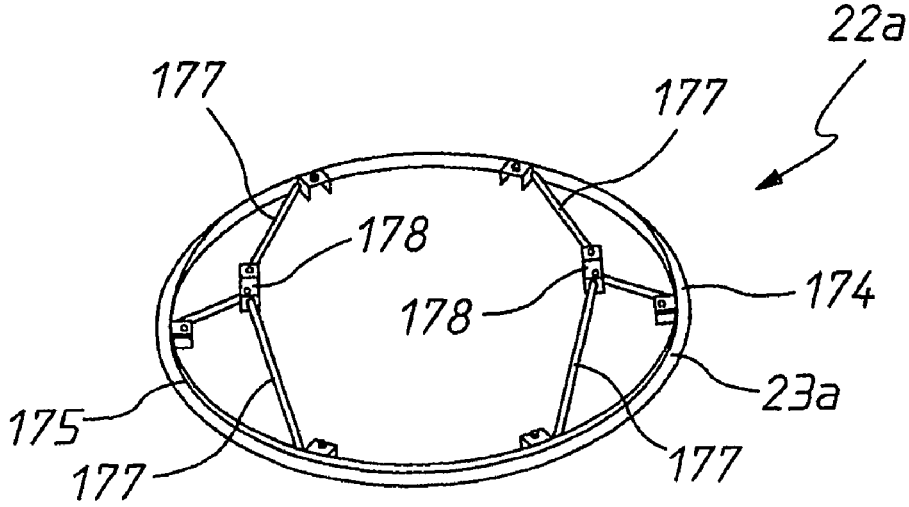
FIG. 17 shows (a) perspective view and (b) elevation view of a modified embodiment of the base plate for the embodiment of FIG. 12.
Figure 17B:
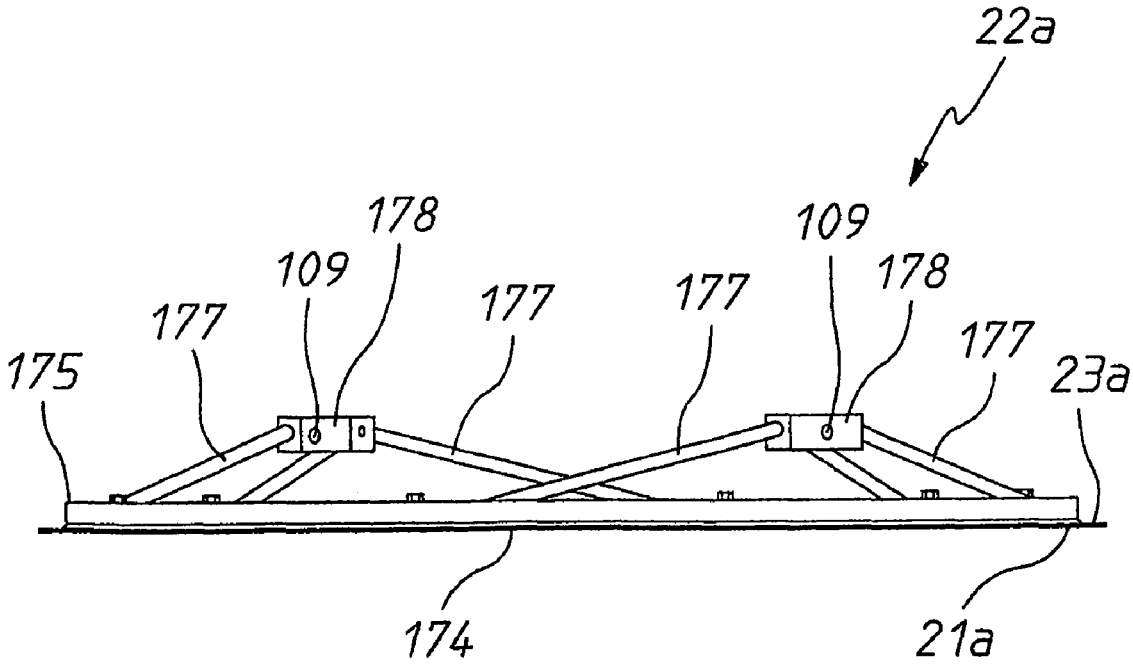

FIG. 17 shows the base plate 22*a*. The base plate 22*a* includes a ring 174 having a lower planar surface 21*a* and an upper planar surface 23*a*. A circular flange 175 extends upwardly from an inside periphery of the ring 174. Extending inwardly and upwardly from the ring 174 are supports 177 for universal joint mounts 178. Two diametrically opposite mounts 178 are attached to the ring 174, each mount 178 having an aperture 109. In the embodiment, the ring 174 is 1.488 m in diameter.

Figure 18:
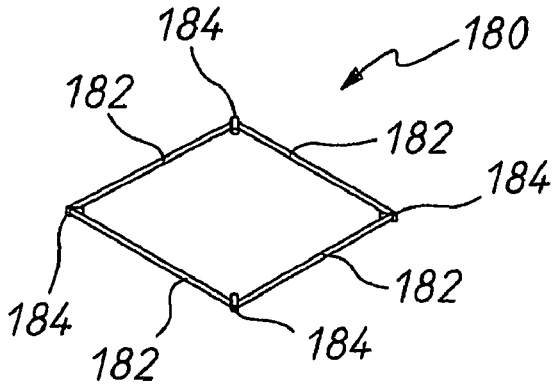
FIG. 18 shows a universal joint member for the embodiment of FIG. 12.

FIG. 18 shows a universal joint member 180. The member 180 is essentially square shaped, having tubes 182 as its sides and bolt nuts 184 at its corners. In the embodiment, the distance between opposite corners of the member 180 is 1.052 m.

Figure 19:
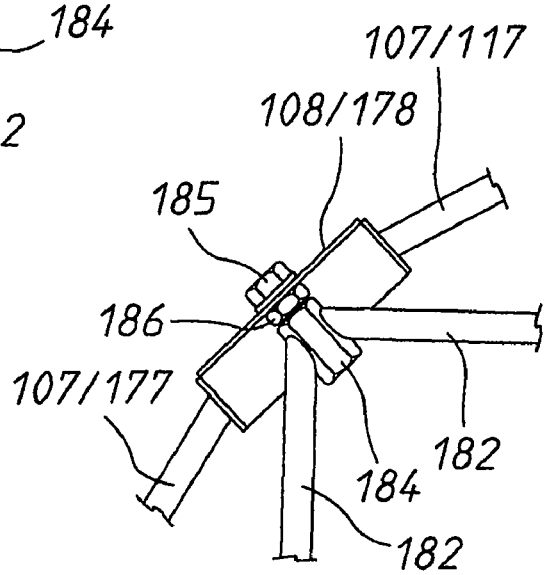
FIG. 19 shows the attachment of a corner of the universal joint member of FIG. 18 to a mount of the top plate of FIG. 14 or the base plate of FIG. 17

FIG. 19 shows the attachment of a joint member nut 184 to a top plate mount 108 or base plate mount 178. A bolt 185 is inserted into each aperture 109 of the mount 108/178, into a second nut 186 and a nut 184 of the universal joint member 180. The second nut 186 is used to lock the bolt 185 onto the mount 108/178. The function on the member 180 will be further described below.

Figures 20A, 20B:
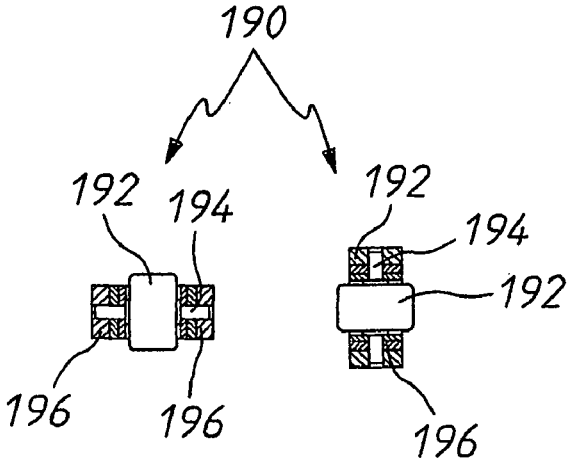
FIG. 20 shows (a) vertical support and (b) lateral support rollers for the embodiment of FIG. 12.
Figure 21:
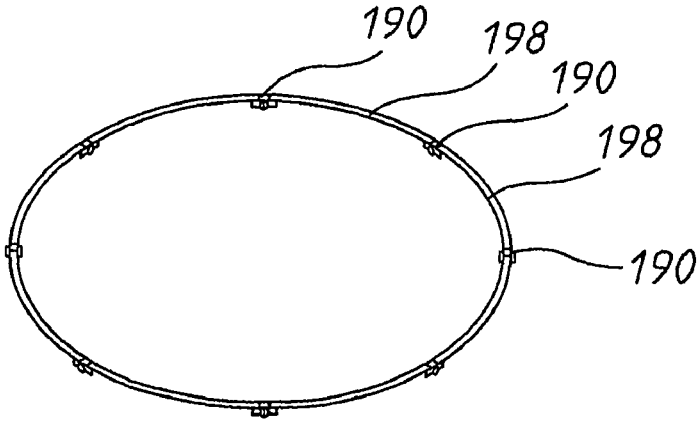
FIG. 21 shows the rollers of FIG. 20 mounted onto spacer frames.

FIG. 20 shows vertical support and lateral support rollers 190. Each roller 90 includes a roller wheel 192 mounted onto an axle 194. Buffers 196 can also be attached to the axles 194. FIG. 21 shows a number of the rollers 190 mounted onto spacer frames 198. The frames 198 engage the axles 194 to maintain the rollers 190 spaced relative to each other as desired. In the embodiment, each location of the rollers 190 will include a vertical support roller and a lateral support roller 190.

Figure 22:
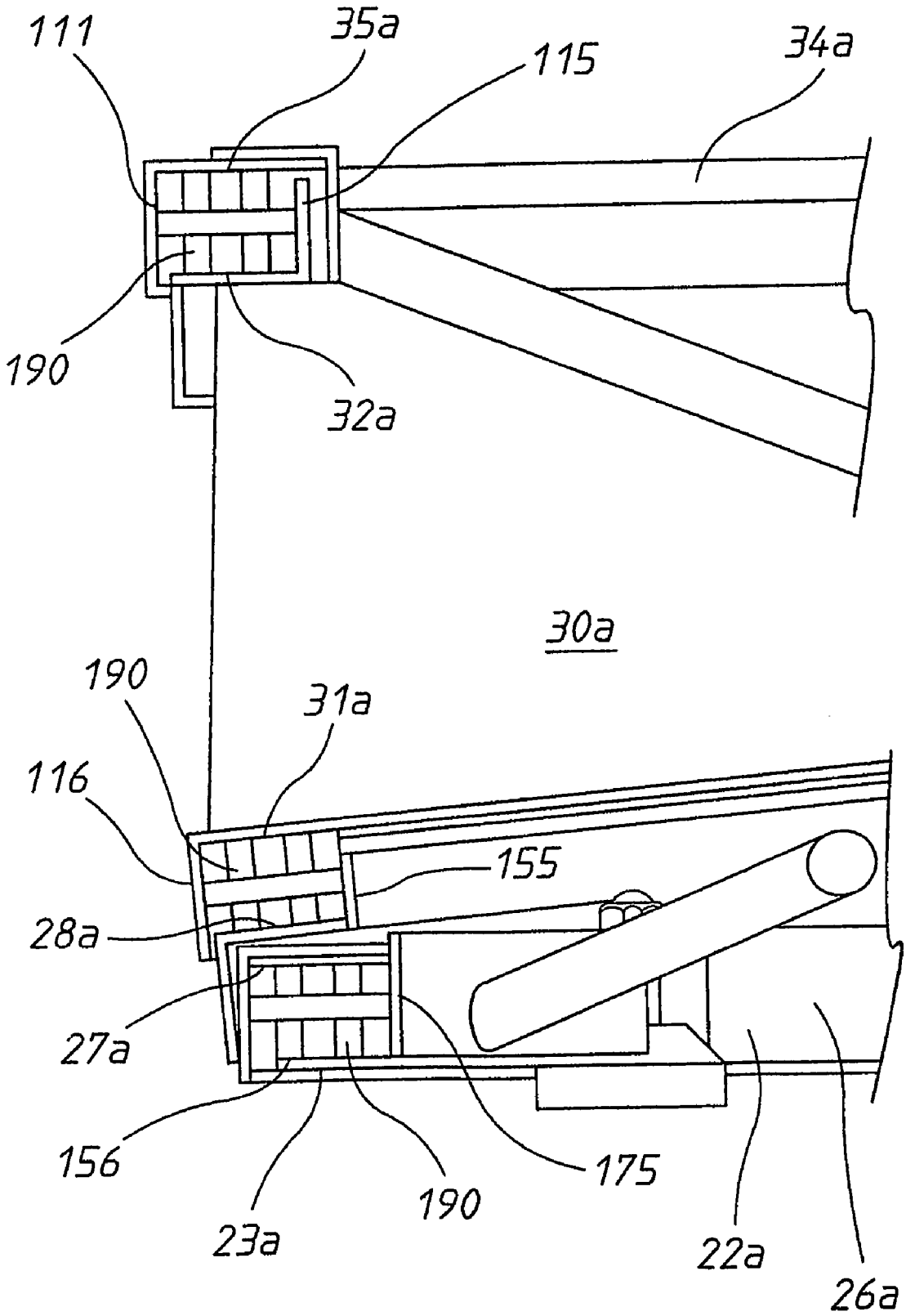
FIG. 22 shows an enlarged view of the part cross-section of FIG. 13.

Referring to FIG. 22, the platform 20*a* is assembled in a similar manner as the platform 20. The lower wedge lower surface 27*a* is disposed above the base plate upper surface 23*a*, with the base plate flange 175 facing and spaced from the lower wedge flange 156. Vertical and lateral rollers 190 mounted onto spacer frames 198 are disposed between these facing surfaces 27*a*, 23*a* and 175, 156 such that the lower wedge 26*a* is rotatable relative to the base plate 22*a*. The rollers 190 are not attached to either the lower wedge 26*a* or the base plate 22*a*.

The upper wedge lower surface 31*a* is disposed above the lower wedge upper surface 28*a*, with the upper wedge flange 116 facing and spaced from the lower wedge flange 155. Similarly, vertical and lateral rollers 190 are also disposed between these facing surfaces such that the upper wedge 30*a* is rotatable relative to the lower wedge 26*a*.

Similarly, the top plate lower surface 35*a* is disposed above the upper wedge upper surface 32*a*, with the top plate surface 111 facing and spaced from the upper wedge flange 115. Again similarly, vertical and lateral rollers 190 are also disposed between these facing surfaces such that the upper wedge 30*a* is rotatable relative to the top plate 34*a*.

The universal joint member 180 connects the top plate 34*a* to the base plate 22*a*. The top plate mounts 108 are positioned such that a line extending through the mount apertures 109 is perpendicular to a line extending through the apertures 109 of the base plate mounts 178. As mentioned above in relation to FIG. 19, each corner nut 184 of the universal joint member 180 is attached to a mount 108/178 via bolts 185.

The base plate mounts 178 allow the joint member 180 to tilt relative to the base plate 22*a* in a first direction. Thus, the top plate 34*a* can tilt relative to the base plate 22 in the first direction. The top plate mounts 108 allow the top plate 34*a* to tilt relative to the joint member 180 in a second direction perpendicular to the first direction. Thus, the top plate 34*a* can tilt relative to the base plate 22*a* in the second direction. The joint member 180 and mounts 108/178 thus allow for a combination of the above first and second tilts of the top plate 34*a* relative to the base plate 22*a*, similar to the joint 42 of the platform 20 above. Each joint member nut 184 may move a small amount relative to its respective bolt 185 when the joint member 180 is tilted. This may translate into a small rotation or movement of the top plate 34*a* relative to the base plate 22*a*. Such a rotation however is minimal and in general, the top plate 34*a* is substantially not rotated or moved laterally relative to the base plate 22*a*, particularly as the maximum tilt of the top plate 34*a* in the embodiment is only 12° as described below.

Independently of the above, the upper and lower wedges 30*a*, 26*a* are rotatable relative to the base plate 22*a*, the top plate 34*a* and relative to each other. The rotation positions of the upper and lower wedges 30*a* and 26*a* relative to the top plate 34*a* and relative to each other determines the amount of tilt and direction of tilt of the top plate 34*a* relative to the base plate 22*a*. The wedges 26*a* and 30*a* in the preferred embodiment are dimensioned to have a maximum top plate 34*a* tilt of 12°. By rotating the lower wedge 26*a* relative to the upper wedge 30*a*, the top plate 34*a* can be tilted relative to the base plate 22*a* by an angle between 0° and 12°, in 1° increments, as provided by the angular distances between the holes 165 in the lower wedge 26*a*. When the desired amount of tilt is achieved, a pin of the lock 129 in the upper wedge lock mount 125 is pushed into a hole 165 to lock the upper wedge 30*a* into the desired angular rotation relative to the lower wedge 26*a*.

The direction of tilt of the top plate 34*a* can be changed by rotating the wedges 26*a* and 30*a* together, relative to the top plate 34*a*. The angular distances between the holes 135 in the upper wedge 30*a* provides for a 5° rotational incremental change in the direction of tilt of the top plate 34*a*. When the desired tilt direction is achieved, a pin of the lock 119 mounted in the top plate lock mount 112 is pushed into a hole 135 to lock the top plate 34*a* into the desired tilt direction rotation relative to the wedges 26*a* and 30*a*.

Figure 23A:
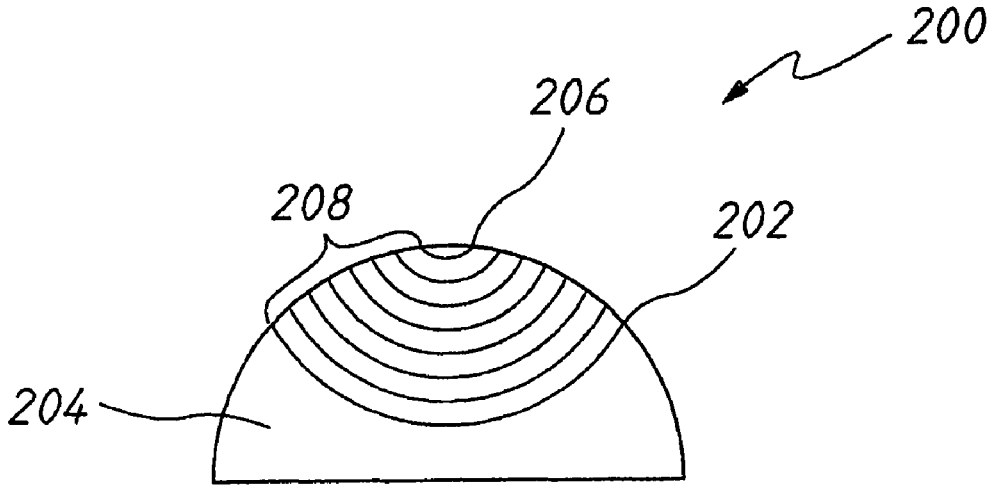
FIG. 23 shows (a) elevation view and (b) plan view of a tilt angle/direction indicator.
Figure 23B:
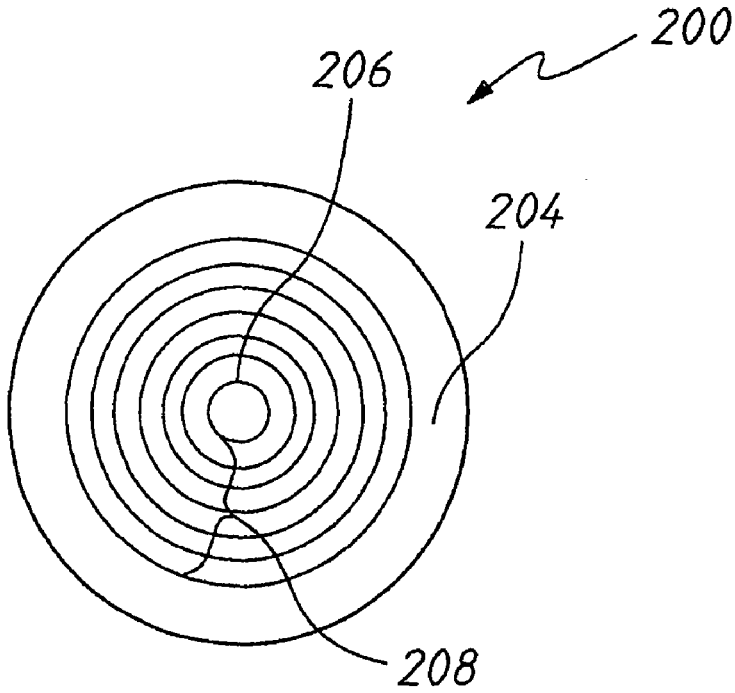

FIG. 23 shows a tilt angle and tilt direction indicator 200 for the platform 20*a*. The indicator 200 is a clear hollow hemisphere 202 filled with a coloured liquid 204. A bubble 206 is retained in the liquid. The hemisphere also includes a number of concentric circles 208. The indicator 200 is mounted onto the top plate top surface 36*a*. When the top plate 34*a* is tilted, the position of the bubble 206 in the indicator 200 will indicate to a user the amount of tilt (via the position of the bubble relative to the circles 208) and the direction of the tilt as the bubble 206 will always move towards the high point of the top surface 36*a*.

It is also possible to use electric motors to rotate the upper and lower wedges 30*a*, 26*a* together and relative to each other. Stepper motors can be used, or indicators and detectors can be mounted between the top plate and upper wedge, and base plate and lower wedge such that the rotation position of the wedges are always known. Such motors will be useful in providing pre-programmed tilt and tilt directions of the top plate, particularly when the platform is used with a virtual golf simulator to simulate play in an actual golf course where contour information is known.

Whilst preferred forms of the present invention have been described, it will be apparent to skilled persons that the invention can be embodied in other forms or that modifications can be made to the embodiments disclosed. For example, the lower wedge can be replaced by an inclined planar upper surface which is supported by pillars and rollers rolling on the base plate. Similarly, the upper wedge can be replaced by an inclined planar lower surface which is supported by pillars and rollers rolling on the top plate. Also, the guide means above can be replaced by engaging corresponding grooves and projections formed between the base plate and lower wedge, the upper and lower wedges and between the upper wedge and top plate.

The present invention can also be manufactured in any desired size, depending on its intended use. For example, a small version about 30 to 50 cm in top plate diameter can be used for ankle injury rehabilitation. The top and lower wedges can be locked relative to each other, but allowed to be rotatable relative to the top and bottom plates. A patient can then place his/her injured foot onto the top plate, and change the tilt and tilt direction of the top plate using his/her foot.

The invention claimed is:

1. A golf driving range platform having:

a base plate having a lower surface and an upper surface, the base plate lower surface being provided to rest on a ground;

a lower wedge having a lower surface and an upper surface inclined relative to each other by a first predetermined angle, the lower wedge lower surface being disposed above said base plate upper surface and supported thereon, the lower wedge being rotatable relative to said base plate about a first rotation axis extending substantially perpendicular to the base plate upper surface;

an upper wedge having a lower surface and an upper surface inclined relative to each other by a second predetermined angle, the upper wedge lower surface being disposed above said lower wedge upper surface and supported thereon, the upper wedge being rotatable relative to said base plate and said lower wedge;

a top plate having a lower surface and an upper surface, the top plate lower surface disposed above said upper wedge upper surface and supported thereon, the upper wedge being rotatable relative to said top plate about a second rotation axis extending substantially perpendicular to the top plate lower surface; and a joint means connecting said top plate to said base plate such that the top plate is substantially not rotatable relative to the base plate, the top plate can tilt relative to the base plate, and the upper and lower wedges are rotatable relative to said top plate.

2. The golf driving range platform of claim 1, wherein the base plate and top plate are circular plates.

3. The golf driving range platform of claim 1 wherein the upper and lower wedges are circular rings.

4. The golf driving range platform of claim 1, wherein the base plate, top plate and upper and lower wedges are substantially similar in diameter.

5. The golf driving range platform of claim 1, wherein the first and second rotation axes are located at the center of the lower and upper wedges respectively.

6. The golf driving range platform of claim 1, wherein the lower wedge lower surface is substantially perpendicular to the first rotation axis.

7. The golf driving range platform of claim 1, wherein the upper wedge upper surface is substantially perpendicular to the second rotation axis.

8. The golf driving range platform of claim 1, wherein the first and second predetermined angles are equal.

9. The golf driving range platform of claim 1, wherein the base plate includes rubber feet at its lower surface.

10. The golf driving range platform of claim 1, wherein the top plate includes a non-slip material at its upper surface.

11. The golf driving range platform of claim 1, wherein the joint means is a universal joint.

12. The golf driving range platform of claim 1, further including guide means for ensuring that the rotation axes of the upper and lower wedges stay in alignment relative to the top and base plates respectively.

13. The golf driving range platform of claim 12, wherein the guide means includes a respective projection of the top plate and base plate which engages the upper and lower wedges respectively.

14. The golf driving range platform of claim 13, wherein the projections includes rollers.

15. The golf driving range platform of claim 1, further including respective rotation means between the base plate and lower wedge, between the lower wedge and upper wedge, and between the upper wedge and top plate, for allowing free rotation of the upper and lower wedges.

16. The golf driving range platform of claim 15, wherein the rotation means includes rollers.

17. The golf driving range platform of claim 1, further including locking means for locking the upper and lower wedges in their selected respective rotation positions relative to the top and base plates.

18. The golf driving range platform of claim 17 wherein the lower wedge can be locked against rotation relative to the base plate.

19. The golf driving range platform of claim 17, wherein the upper wedge can be locked against rotation relative to the top plate.

20. The golf driving range platform of claim 17, wherein, the lower and upper wedges can be locked against rotation relative to each other.

21. The golf driving range platform of claim 1, further including a first motor mounted on the base plate upper surface for engaging the lower wedge for rotating the lower wedge.

22. The golf driving range platform of claim 21 wherein further including a second motor mounted on the top plate lower surface for engaging the upper wedge for rotating the upper wedge.

23. The golf driving range platform of claim 21, wherein the first and second motors are operable to substantially prevent rotation of the lower wedge and upper wedge, respectively.

* * * * *